US008745792B2

(12) United States Patent
McGlynn

(10) Patent No.: US 8,745,792 B2
(45) Date of Patent: Jun. 10, 2014

(54) FIREFIGHTER RAPID EMERGENCY EXTRACTION DEVICE

(75) Inventor: Douglas McGlynn, Royal Palm Beach, FL (US)

(73) Assignee: Douglas McGlynn, Royal Palm Beach, FL (US)

( * ) Notice: Subject to any disclaimer, the term of this patent is extended or adjusted under 35 U.S.C. 154(b) by 671 days.

(21) Appl. No.: 12/925,837

(22) Filed: Nov. 1, 2010

(65) Prior Publication Data

US 2012/0102650 A1 May 3, 2012

(51) Int. Cl.
*A47B 1/00* (2006.01)

(52) U.S. Cl.
USPC ..... 5/627; 5/625; 5/626; 5/81.1 R

(58) Field of Classification Search
USPC ..... 5/81.1 T, 81.1 R, 110, 111, 625–629; 128/869, 870, 846
See application file for complete search history.

(56) References Cited

U.S. PATENT DOCUMENTS

| | | | | |
|---|---|---|---|---|
| 2,607,103 | A * | 8/1952 | Davidson | 27/28 |
| 3,135,972 | A * | 6/1964 | Jakes et al. | 5/627 |
| 4,442,557 | A | 4/1984 | Clemens | |
| 5,014,724 | A * | 5/1991 | Miller | 128/870 |
| 5,189,746 | A * | 3/1993 | Horie | 5/627 |
| 5,375,277 | A | 12/1994 | Carr et al. | |
| 5,745,938 | A | 5/1998 | Bartley et al. | |
| 5,787,529 | A | 8/1998 | Landes | |
| 5,803,087 | A * | 9/1998 | Thompson | 128/870 |
| 5,829,078 | A * | 11/1998 | Rivers | 5/629 |
| 6,195,822 | B1 * | 3/2001 | Sorensen et al. | 5/628 |
| 6,227,201 | B1 * | 5/2001 | Ferko, III | 128/869 |
| 6,824,150 | B2 | 11/2004 | Simione | |
| 6,871,368 | B2 | 3/2005 | Calkin | |
| 7,302,723 | B2 | 12/2007 | Dean | |
| 7,810,190 | B1 * | 10/2010 | Antonio | 5/627 |
| 2007/0192926 | A1 | 8/2007 | Fee et al. | |

* cited by examiner

*Primary Examiner* — Robert G Santos
*Assistant Examiner* — David E Sosnowski

(57) ABSTRACT

A Firefighter Rapid Emergency Extraction device or F.R.E.E. Sled, is an emergency piece of equipment that acts as a rapid removal sled in which to apply to a downed firefighter, FF, within moments of locating or arriving at the victim. The F.R.E.E. Sled allows for the low profile loading and packaging of the downed FF as well as a securing strap for the RIC bag and air supply unit so that it stays with the victim. The instant invention allows the rescuer to quickly retrieve the compactly stored sled from the storage compartment of their own response vehicle, enter, locate and package the victim without the need for converting the gear that may be worn by the victim-firefighter. The F.R.E.E. Sled easily allows the operations level rescuer to secure the harness system in low-to-zero visibility environments with the "Twin Strap-Two Snap Buckle" method faster and more efficient than any other device available in the rescue art without having to remove the rescuers' protective gloves to accomplish this task. The instant invention stands to revolutionize the way the fire service saves one of their own in these Rapid Intervention deployments.

23 Claims, 9 Drawing Sheets

FIG. 3
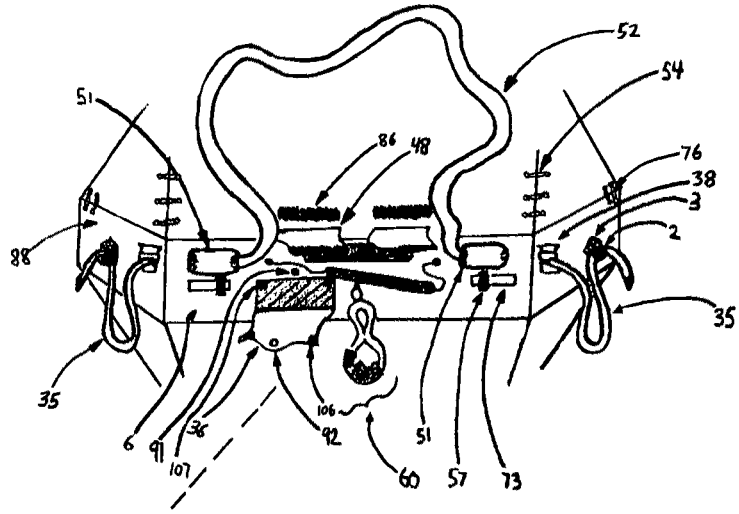
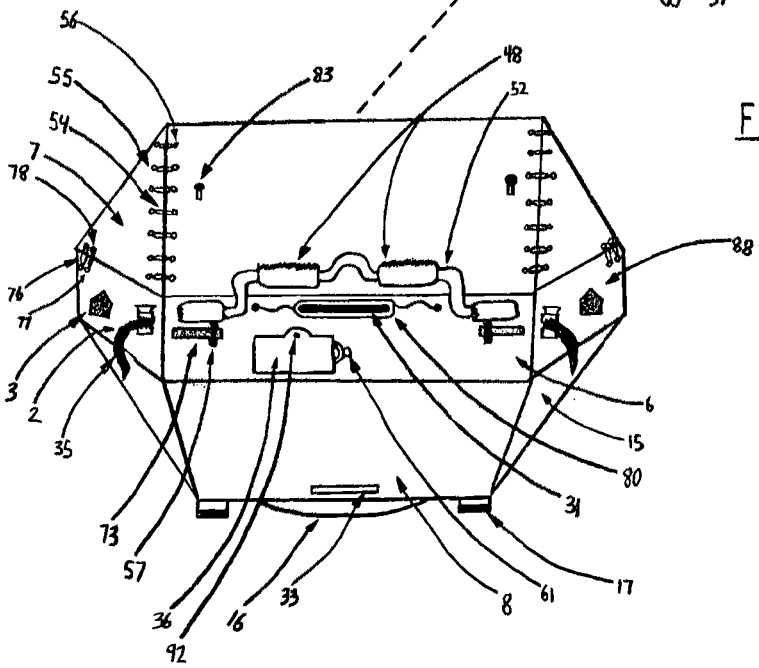
FIG. 3(a)

FIREFIGHTER RAPID EMERGENCY EXTRACTION DEVICE

FIELD OF THE INVENTION

The instant invention relates to a specific and intended target incident of use (ITIU) where emergency rescue procedures are rapidly initiated for a downed firefighter (FF) operating within the interior and/or exterior spaces of an operating environment that is deemed to be, or is suspected to become, Immediately Dangerous to Life and Health (IDLH). The instant invention refers more specifically to the preparation and packaging of un-ambulatory firefighter(s) in this ITIU while dressed in full personal protective equipment (PPE) including self contained breathing apparatus (SCBA) regardless of the rescue positioning of the victim into the instant invention, Firefighter Rapid Emergency Extraction device, or FREE Device. The intent is that rescuers may apply the device with minimal points of attachment using a basic means of securing the device to the victim without having to alter, modify or remove the victim's gear in order to facilitate removal of the victim from the area of hostile environment to an area of safe refuge in the quickest manner possible.

BACKGROUND OF THE INVENTION

There are numerous rescue devices presently in existence that focus on extricating persons from hazardous environments including confined spaces, below grade environments, narrow trenches and hard to reach areas. Many rescue devices and equipment concentrate on maintaining a neutral inline position to the cervical spine of persons identified as patients and therefore those pieces of equipment are to be classified separately as cervical immobilization devices (CID). The instant invention is not a CID or an emergency extraction device considered for persons when indications exist for a cervical spine board in order to safely remove the victim without further injury. The instant invention is designed for persons that require rapid removal and extrication from a hostile and hazardous environment as a matter of life and death. Unfortunately, the prior art in this field of rescue consists of inefficient equipment that is either inapplicable to the given scenario or impractical in design for the operation at hand. It is the object of the background of the instant invention to offer differentiation between it and the large quantity and variety of prior art. The instant invention is designed for situations where any delay in attempting to make the environment more manageable or time spent on sorting through the absolute best way to package, secure and remove a victim, even with suspected cervical spine injury as opposed to separating the victim from the hazardous environment greatly increases the chance of victim fatality including loss of life or limb to the victim and/or rescuers themselves.

It is also important to state that the instant invention is not designed to primarily address persons that are already deemed as patients, or where a patient-responder relationship has already been established as defined within the statutory requirements of patient consent laws in a given state and/or the pre-hospital emergency medical service protocols of the authority having jurisdiction (AHJ). This consent to medical assessment, evaluation and possible package and transport should be established, identified and confirmed prior to any emergency responder intervention for those persons deemed as patients. This clearly is not the type of incident defined as the primary or intended target incident of use (ITIU) of the instant invention, however the possibility of applying the instant invention in such circumstances should not be ruled out once intervention has been initiated by the emergency team. Although the instant invention may prove to be useful in certain situations where patients may require intervention in order to move them from point A to point B, it is not the primary goal or spirit of the instant invention despite it's useful application in those situations. The instant invention, Firefighter Rapid Emergency Extraction device and the innovative design it offers complements the rescue application in the purpose of a sled, more specifically a Firefighter Rapid Emergency Extraction sled or F.R.E.E. Sled. It is primarily designed to rapidly remove persons before a patient responder relationship has been initiated, and where the status of those persons requiring rapid removal via the instant invention are still classified as victims in harms way. Furthermore, the instant invention primarily addresses the "life and death" need to quickly locate, package and remove that victim as rapidly and as efficiently as possible without immediate concern to the underlying cause of immobility that would prevent and/or cause delay of the victim requiring rapid removal from the immediate hazard from which the victim is located. It is not until the victim is successfully extracted from the hazardous environment and turned over to outside emergency medical service (EMS) personnel that patient consent laws begin to apply, therefore, the F.R.E.E. Sled contrasts from many medically related removal devices, stretchers, stokes baskets, or patient transfer contraptions designed to perform both EMS duties and removal sequence activities simultaneously including those devices classified as CID's. Despite the lack of clear delineation within the field of prior art of technical rescue, there remains a profound difference between patient transfer devices and/or stretchers and the classification of emergency victim removal devices. The prioritized application for the instant invention is for the rapid package and removal of injured and/or un-ambulatory firefighters from environments deemed or suspected to become IDLH. The ITIU of the instant invention is for instances without the rapid package and removal component, death would prove imminent to anyone remaining inside that environment regardless of the victim's or rescuer's level of protective gear worn at that time. The instant invention is streamlined not for the advanced level rescue technician, but so the commonly staffed firefighter can deploy to the victim location, apply the device with minimal points of attachment using a basic means of securing the device without having to alter, modify or remove the victim's gear in order to facilitate removal from the area of hostile environment to an area of safe refuge in the quickest manner possible. The instant invention also offers the option for the rescuer to simply pass a common fire service rope onto a permanently attached mechanical advantage revolver clip, also referred to as the M.A.R.C. (Mechanical Advantage Revolver Clip), which by doing so easily creates a 2:1 mechanical advantage for use as a horizontal haul system or lowering device without the complicated aspects of technician level skill, gear, familiarity and equipment such as, but not limited to rope, block, tackle & pulley systems. This allows the operational level crewmember to quickly deploy the extraction device in a heated, hostile and low visibility environment without technician level training needed to perform the life-saving task.

In the rescue art there are two rules of thumb to categorize what method of rescue application should be used in emergency response mitigation. They are: the "load and go" scenarios and the "stay and play" situations. The instant invention, although a useful tool in some "stay and play" type scenarios, it is prioritized in design for the life threatening conditions of that impending emergency environment when operating crews must act and deploy quickly for that true "load and go" situation. Again, this environment is further described as the ITIU of the instant invention, more specifically the F.R.E.E. Sled. There are rescue devices that do not claim to maintain cervical immobilization, however, they do focus on packaging and extracting individuals that are non-ambulatory and are unable to self rescue either due to the hazards of the environment or immobility secondary to injury or incapacitation. Many of these devices in this next category concentrate on rescuing individuals or persons that are not dressed in a full ensemble of structural firefighting gear and apparel including, but not limited to firefighter bunker pants & boots, jacket, helmet, gloves, full protective respiratory face mask and bottle pack-mounted air supply in the form of an SCBA (Self Contained Breathing Apparatus). Although many of these non-CID rescue devices in this area of prior art are not specifically geared towards rescuing the fully dressed out firefighter in a true firefighter emergency they are, however, classified as technical in nature. The devices that apply to this technical aspect of prior art possess inherent technical standards that limit the application, knowledge and use of the equipment and require technical training of the rescuer to perform the operation of such said devices and/or equipment set forth by the Authority Having Jurisdiction (AHJ).

In this non-CID, non-medical, technical area of rescue art there are three main levels of proficiency and performance. The three levels are: Awareness, Operational, and the more advanced level of Technician. A basic level of orientation training is necessary to familiarize a rescuer in order to meet the Awareness level of certification. Most emergency rescue providers combine this Awareness level training with the next level, Operational. As the anticipated system or level of situation expands, the requirements for the training, operational skills, management ability, and type of equipment also expand to the level of that skill demanded. The NFPA, National Fire Protection Agency, is the leading authority on fire, electrical and building safety. This organization establishes written standards for minimum job performance requirements (JPRs) necessary for fire service and other emergency response personnel who perform firefighting activities including the detailed requirements of technical rescue operations.

There are many rescue situations that involve particular rescue devices, equipment and ensembles that require awareness and operational levels of training, but do NOT require certified documentation in order to perform those tasks. This is the case with any non-technical rescue situation regardless of how unique the rescue incident appears to be. This is certainly the case with the many rescue procedures performed by countless fire fighters and emergency rescue personnel as they respond to an unlimited variety of rescue situations such as, but not limited to; elevator shaft rescue, motor vehicle extrication, high rise fire search and rescue, structural firefighting, emergency escape operations, firefighter bail outs, etc. The instant invention is designed for this critical, yet non-specialty area of rescue and more specifically for the area referred to when a crew or team must be activated to respond to a fallen, injured or lost fire fighter inside an IDLH environment when the situation cannot wait for a special response team of certified rescue technicians to respond and perform rescue & extraction procedures. These tasks require a rapid intervention from an outside team or crew that is on scene, in place and ready to be activated in order to save the victim's life from the environment previously described as the ITIU of the instant invention and cannot afford the delay, and redundancy that technical rescue incidents mandate and require. This crew of operational emergency responders or team of fire fighting personnel that stand ready at emergency incidents are a fire service standard and are referred to as a Rapid Intervention Crew (RIC) or group of RIC personnel such as a Rapid Intervention Team (RIT). For the purposes of the instant invention and description, the terms RIC and RIT will be used interchangeably and reflect no variance in the performance or definition of such a team or crew when deployed to function in the RIC/RIT capacity at emergency situations. Although this should be a specialty type of rescue assignment with strictly adhered to standards, it is relatively new to the fire service/emergency rescue art and therefore it is in fact an emerging rescue practice that demands more standardization and improvement. In fact the NFPA has developed a new standard that specifies what the basic training procedures will be for fire personnel in order to conduct fire fighter rapid intervention operations as specified in situations mentioned above. In existing written standards such as, NFPA 1710, *Standard for the Organization and Deployment of Fire Suppression Operations, Emergency Medical Operations, and Special Operations to the Public by Career Fire Departments* as well as NFPA 1720 which specifies the same for Volunteer Fire Departments these listed activities require the operational fire fighter and/or responder to perform rapid intervention activities without technician level skill, training, or certification. The NFPA establishes general guidelines to what a RIC will entail, but without the newly developed standard on rapid intervention activities above and beyond what an Incident Commander will assign at a fire emergency, there lies a system-wide gap on what activities should be performed and what equipment specifically should be carried by personnel once assigned as a rapid intervention crew. The newly established standard as of March 2010, NFPA 1407 *Standard for Training Fire Service Rapid Intervention Crews*—2010 *Edition* will address the creation of a standard that specifies minimal acceptable performances during training for rapid intervention activities. This new Rapid Intervention Standard also specifies accessing, extricating and moving downed fire fighter(s) to safety during a fire fighter emergency declaration. Chapter 7 of NFPA 1407 specifically states the use of ropes, slings, harnesses and mechanical advantage rescue systems in the emergency removal of downed fire fighter(s). In chapter 7 of NFPA (Moving downed fire fighter(s) to safety), the skills required shall include rescue baskets and/or boards with simple systems for gaining mechanical advantages whether out elevated and restricted openings such as a window or down a fire service ladder. Lastly, the standard clearly states in chapter 8 of NFPA 1407 that the equipment rescue personnel deploy as well as the techniques that shall apply must be approved by the AHJ (Authority Having Jurisdiction). It is the lack of effective intervention and extraction devices available that prevent operational level personnel to fill those tactical assignments at emergency incidents while at the same time, keep the emergency extraction non-technical yet still effective. It has been left up to the (AHJ) or individual fire rescue organization to either adopt the common standard or come up with their own RIC program or assignment that may or may not standardize and define such specialized assignments, tools, and equipment despite the NFPA recommendations. There are no state mandates or NFPA recognized certifications that exist that would qualify or require such individuals to obtain technician level certification in order to perform in the RIC capacity at emergency incidents. Up until this point it also meant that there was no written standard for the type of rescue equipment that must and will be included to facilitate this very demanding firefighter packaging and emergency extraction operation until the March 2010 release of NFPA 1407, *Standard for Training Fire Service Rapid Intervention Crews*. The National Incident Management System suggests what emergency air provision procedures will be included during rapid intervention rescue operations and that an emergency air system shall exist. This emergency air system is also mandated in the newest NFPA Standard 1404, *Standard for Fire Service Respiratory Protection Training* and it addresses a Rapid Intervention Equipment Bag encompassing a reserve air supply bottle, an emergency breathing supply system, a universal air connection port and possibly a mask. Although this standard is now emerging for what equipment a RIC will equip themselves with it also recommends the following: a common fire service rope, hand light, portable radio and a RIT/RIC Bag. It is the emergency extraction equipment that is lacking in these newly equipped rapid intervention teams and existing proposals and/or standards. The newly implemented standard, NFPA 1407, is the first of it's kind that actually recommends rapid intervention personnel to utilize mechanical advantage systems, rope, and an extraction device such as a board or basket carrying device for the preparation and training phase of rapid intervention practices. When it comes to extracting the firefighter victim out of the fire building emergency in real life, the crews most often resort to a "find and drag" out strategy since the training standard had not existed for what tools, equipment or guidelines fire fighters would follow while performing these life saving objectives. Firefighters when faced with great adversity often resort to their basic level of training and with NFPA 1407, *Standard for Training Fire Service Rapid Intervention Crews* now available we can begin to see a positive foundation to standardized rapid intervention practices. The instant invention stands to revolutionize the way firefighters approach rapid intervention operations at emergency incidents. When it comes to the basic tools that fire fighters often resort to are the basic tools that they have on their person since rapid intervention emergencies often occur with little warning. These tools are basic firefighting equipment and every firefighter on the fire-ground should have with them such as a portable radio, a personal rope bag and a hand-held flashlight. Many firefighters carry their own personal rope bags and webbing straps for tag lines on searches, however every fire engine in America is equipped with at least 100' of common fire service rope in a portable carrying bag. RIC operations that involve removing an un-ambulatory firefighter free from an IDLH environment will overwhelm the rescuer that is merely equipped with the bare minimum tools such as a radio, rope bag and a flashlight as far as the removal and extraction process of rapid intervention activities is concerned. The introduction of the instant invention, F.R.E.E. Sled stands to actualize the fundamentals of this newest national standard, NFPA 1407, for the fire service. Until now, no such equipment recommended in NFPA 1407 existed that would function specifically in the rapid intervention environment. Not even the newly mandated RIC Bag would aid the rescuer during the package & removal portion of the operation to the level of what the F.R.E.E. Sled stands to offer when it comes to rescue and extraction. The Firefighter Rapid Emergency Extraction Device or, F.R.E.E. Sled prepares the rescuer to meet the challenges faced in the ever-changing world of Rapid Intervention in every facet of the operation, especially in the removal and extraction phase of the emergency. The F.R.E.E. Sled incorporates the basic tools already carried and includes them into the operation of the instant invention during the emergency extraction while specifically making provisions for a mechanical advantage system built-in that remains simple just as specified in the new NFPA 1407 standard. To date, there is no such device that addresses the mechanical advantage concern by means of simple connections. In addition, the specific challenges that prior art fail to address is what the object of the instant invention's description intends to illustrate while demonstrating how the F.R.E.E. Sled overcomes those shortcomings that pertain to mitigating the rescue of incapacitated and/or un-ambulatory victims dressed in full firefighting protective gear within the IDLH atmospheres of the ITIU described.

Most agencies of the modern fire service have adopted the assignment of dedicating a firefighter based emergency rescue crew to standby ready to perform as a RIC in case a rapid intervention was deemed necessary or called upon by the fire-ground Incident Commander (IC). However, if a RIC is activated at an emergency fire scene, it is the complexity of this operation and the lack of operational level tools, devices and equipment that drop the success rate of these RIC activations to unacceptable levels. Despite this previous fact, it is the delay in the activation of a properly staffed, trained, and highly equipped Rapid Intervention Crew that often remains a common factor when studying the Line of Duty Death (LODD) reports where firefighter fatalities resulted. In fact statistics have proven that RIC is anything, but "rapid", according to fire service LODD reports issued and published by the National Institute of Occupational Safety and Health (NIOSH). The greatest percentage of firefighter (FF) LODDs occur within single-family residential structures and not in high-rise buildings or large commercial occupancies. This can be surprising for some to understand at first since the floor plans and interior layouts of these structures may seem fundamentally basic in nature. However, the interior spaces of these common residential homes, whether single family or multiple dwelling occupancies, become massive debris piles riddled with entanglement obstacles that create inherent hazards as firefighters enter, operate, and sometimes have to retreat in a hurry due to declining interior conditions or in the presence of an impending hostile fire event. Under normal operating conditions these structures, mostly comprised of lightweight pre-manufactured truss assemblies and synthetic based construction materials along with engineered lightweight fasteners (laminated wooden I-joists, oriented strand board and gusset plates to name a few), hold up remarkably well to the loads that were designed for them in non fire related events. It is when these members, systems and components are subjected to the heat intensified insult of an interior structure fire that they begin to fail resulting in the compromise of the overall building strength and inability to properly deliver the engineered load of the building or structural components to it's designated resting place. These failed building components result in collapse into the interior spaces where unsuspecting firefighters are operating. The environment in the attic & overhead becomes unstable, the drop ceiling above begins to deteriorate and further be exposed to super-heated elements, which further reduces the structural integrity of these overhead fasteners along with copious amounts of electrical wire, HVAC (Heating, Ventilation & Air Conditioning) duct coil and exhaust insulation. As more products become available to the fire, these contents begin to fuel the growth of the fire-spread causing the structural components to loose structural integrity and fail. This failure to maintain integrity and load results in more partially combusted debris to litter the ground in, around and below the interior ceiling of the structure causing an already IDLH environment to become an imminent life threat to any person occupying the space in addition to impeding the means of egress for interior operating occupants, victims and firefighters alike. In addition to the heat intensified insult of the interior environment at these structure fires, it is the synthetic nature of the building contents such as furniture, carpeting, computers and televisions in the occupant spaces that put off an incredible HRR (heat release rate) in addition to higher overall units of heat measured in BTUs (British Thermal Units). Synthetic materials are known to put out 3-4 times the total heat that a similar weight of natural material would generate under fire conditions in addition to how incomplete the combustion process results when involving synthetic materials. The smoke production is incredibly thick and carbon rich with partially combusted synthetics. Visibility is very poor and the carbon rich smoke becomes superheated throughout the entire occupant space directly communicating from the fire involved area. This superheated smoke causes firefighter disorientation due to the lack of visibility and how quick interior conditions can change with modern day combustibles in typical occupancies. NIOSH studies have documented that in recent LODD reports where firefighter fatalities had resulted were contributed to this dark, superheated hostile smoke causing firefighters to get disoriented, lost, and/or trapped before running out of air. The major cause of firefighter death inside structure fires was not heat-insulted injuries, but simply smoke inhalation. If only a rapid intervention crew can arrive to the aid of a lost, trapped, and/or disoriented firefighter quickly enough to render the fresh air bottle applicable and remove the victim timely enough where the rescuing RIC members would not run too low on their own air supply, we could prevent needless deaths of our firefighters in these preventable situations. Never will provisions cover every facet of every firefighter emergency, however, if it is discoverable then it is preventable. NIOSH has stated what factors exist in recent LODD fatality reports and the instant invention addresses those concerns specifically. Here, in this ITIU, is where the instant invention was designed to be applied rapidly by awaiting RIC crewmembers, and without the delayed response from technical intervention teams that are not even on scene yet. If and when a FF or victim finds themselves in this above described ITIU and can't get out on their own accord, it is the rapid location, intervention and emergency extraction from an outside deploying crew or team that changes the tragic outcome that makes the difference. Here is what is described as the operating environment of Rapid Intervention Crewmembers and is specifically the ITIU of the instant invention.

The F.R.E.E Sled is designed to be operated by non-technical fire rescue workers into areas that are non-technical in nature despite the high-risk involved with the described ITIU of the instant invention. Due to the contrast in the ITIU and the previously mentioned field of prior art and technical rescue, some more information is warranted in order to fully understand the scope of such rescue fields.

To confirm that the instant invention does not meet the technical standard requirements of technical rescue operations where actions, equipment and personnel may be limited in performing such activities without certifications, it is critical that some supportive background on the topic is overviewed before proceeding further.

For some background on these specialized technical rescue operations, NFPA 1670: *Standard on Operations and Training for Technical Search and Rescue Incidents* is the applicable standard for such operations with the most current edition updated as recent as 2009. This standard establishes the minimum job performance requirements (JPRs) necessary for fire service and other emergency response personnel who perform technical rescue operations. As mentioned earlier there are three main levels of rescue proficiency in the Technical rescue field. The levels are Awareness, Operations and Technician level. Any technical rescue device, equipment, ensemble or area of rescue skill that falls into this third category, Technician or Technical Rescue Operation, requires full documentation of proficiency in each of the three levels of training proficiency (Awareness, Operation, & Technical) as well as documented JPRs to ensure that the standard is kept current within the organization that is responsible for responding to such incidents. This is usually in the form of certification from a training facility or organization that is qualified to train those rescue proficiencies in that particular state regarding that particular rescue art (e.g.—High Angle Rescue, Trench Rescue, Hazardous Materials (HAZMAT), Confined Space,) etc. If the rescue is classified as a specialized technical area that is covered in the standard for technical rescue situations, NFPA 1670, will require that the three levels of certification apply according to the adaption by the AHJ, therefore establishing strict language of what a rescuer can and cannot do depending on what level of certification they have regarding that particular rescue. NFPA 1006 *Standard for Technical Rescuer Professional Qualifications* 2008 *Edition* outlines the specific emergency incidents that apply to the standard as well as defines each incident for purposes of applicability. The most common specialized rescue situations that fall into NFPA standards and that are clearly listed under NFPA 1006 are, but are not limited to: Trench Rescue, High Angle Rescue, Rope Rescue, Dive Rescue, Surface/Swift/Ice/Surf Water Rescue, HAZMAT, Heavy & Large Vehicle & Machinery Rescue (VMR), Structural Collapse, Cave Rescue, Mine & Tunnel Rescue and Confined Space Rescue (CONSPACE). Many of the rescue devices, technical utility ensembles and equipment that are applicable in these specific rescue emergencies are designed for the highly trained, highly skilled rescue technician, and any application without the current and acceptable technician level certifications would be considered operating outside the scope of practice for that particular skill or emergency. This is clearly outlined in a separate standard by the NFPA, National Fire Protection Agency, under NFPA 1951: *Standard on Protective Ensembles for Technical Rescue Incidents*. In the rescue art, this third and most advanced area of rescue operation requires this technical area of expertise to be governed by written standards of the NFPA with adoption of the AHJ. Although there may be several different names for local or regional teams that operate within this capacity such as "Special Operation Teams" or "Technical Rescue Response Units", the standard that applies to those operational situations remains the same for each. The instant invention, although at first may strike resemblance and similarity to a technical rescue device, it is NOT held to the technical standard outlined in the NFPA standards or any government mandate for requiring such measures, mainly because it's design has been customized for the Operational level crew to deploy. This will be a key component to the enhancement and improvement of the rescue field of invention regarding the introduction of the instant invention, F.R.E.E. Sled as it pertains to the emerging field of rescue art, rapid intervention operations at fire-ground emergencies.

Since the instant invention is not a technician level piece of equipment and it is geared for the operational emergency responder to operate with little sophistication to the level of training needed to become oriented or familiar with the rescue device, no JPR's are needed for the rescue extraction device or that particular level of rescue skill in order to perform the task. The instant invention is free from any standardized technical attachments including but not limited to any single and/or double sheave pulley systems, rope rigging hooks, vertical hoist ascenders and/or descenders or mechanical advantage locking devices that require a technical standard to regulate it's application, care, maintenance, documentation and use. The instant invention also has an intended target incident of use (ITIU) that is not described within the technical standards of the NFPA.

The instant invention has an ITIU specifically designed for rescuing, packaging, and extracting downed FFs from areas deemed IDLH when immobility or incapacitation exists for a FF requiring rescue while wearing full PPE including SCBA. These fire related incidents do not fall within the technical guidelines of NFPA 1670: *Standard on Operations and Training for Technical Search and Rescue Incidents* since the incidents are not categorized as technical. Unless the downed FF concerned is unable to self rescue due to some other structural hazard such as a Confined Space, a Trench, a HAZMAT environment or who has been subjected to a Structural Collapse that involves more than what an operational responder may be able to mitigate without specialized skill, technique and/or equipment to resolve, then the technical standard need not apply to the situation or the qualification of use of the instant invention. If such a technical case scenario does in fact exist, then a Technician level responder will be warranted to carry out the operation as well as adhere to any applicable standards that would be associated with the technical operation at hand. For the ITIU of the instant invention, these will be operational level fire incidents where a F.A.S.T. (Firefighter Assist and Search Team) or RIC/RIT deployment is necessary or has been assigned to standby at the discretion of the Incident Commander (IC). Under the National Incident Management System (NIMS) the term RIC/RIT will be used to describe these (F.A.S.T.) Firefighter rescue and assist teams and all terminology to describe the such will be used universally.

This ITIU of the instant invention is also not included within the lead standard, NFPA 1006 which clearly outlines the specific emergency incidents that apply to the standard as well as defines each incident in specific categories of rescue operation. The ITIU of the instant invention is based on the operational level skills required of any FF working at a typical structure fire where operations inside may be deemed or suspected to become IDLH. These operational level FFs may be deployed with little notice and no additional training warranted at a technical level in order to carry out the potential tasks of rescuing the fallen FF who is unable to self-rescue for whatever reason may be known or unknown at the time of deployment.

The instant invention is designed specifically for this operational level crew, commonly referred to as the RIC. Furthermore, under NFPA 1951: *Standard on Protective Ensembles for Technical Rescue Incidents* under connotation 1.1.9, it clearly states, "This standard shall not establish criteria for protection for any fire-fighting operations". As reminder, NFPA 1951 also specifies the minimum requirements for the various elements of the utility technical rescue ensemble itself which would not include the dimensions or specifications described in the instant invention or description of the F.R.E.E. Sled. Any non-technical rescue device or rescue situation that does not fall into the advanced parameters of the technical standards or proficiencies suggested shall be deemed as Operational level skills and thereby categorized similarly as the ITIU of the instant invention.

In Summary, the instant invention drastically varies from other similarly designed devices intended to merely remove victims from hazardous environments without consideration for FF's wearing full PPE including a bulky, back-pack mounted air supply system such as an SCBA. In addition to this critical point of difference from prior art and other rescue equipment, the attachments to the instant invention also set it apart from anything available in the rescue community currently. Most packaging devices, rescue boards or sled types of equipment involve elements of attachment that are so basic and unsophisticated that it leaves the packaged victim unsecured. In contrast some of the attachments in the prior art are part of a sophisticated technical rescue device that falls within the technical standards of NFPA according to the earlier descriptions and are in fact outside the ITIU of the instant invention described in the background above, and are not compatible with the same level of application regarding the level of equipment defined as the instant invention, F.R.E.E. Sled. Some of the prior art clearly state in their patent descriptions such terminology such as "a plurality of secured attachments" where the quantity of straps may secure the packaged victim in a more superior manner than the instant invention or perhaps allow for more advanced lift and extrication such as high vertical ascents amongst multiple stories or hoisted above grade levels from an aerial device or helicopter. The task is, was and always will be about saving a fallen rescue worker as quickly, rapidly, and efficiently as possible without delay while within the hazards of the described environment of the ITIU for the instant invention, further described as IDLH. Here those members are protected in a full ensemble of firefighting gear including fire helmet and SCBA apparatus. Furthermore, this full ensemble of firefighting protective equipment and gear is not required to be modified, altered or removed in order to necessitate such emergency removal regarding the application of the instant invention, particularly regarding the firefighter's helmet and back-mounted SCBA. Keeping the instant invention at the operational level of equipment and design will ensure that FF's operating in these RIC positions have the necessary extraction device with them, such as the instant invention, at the time of deployment for rescue operation instead of having to call for it or request a specialized team of rescue technicians to respond while the downed FF lay inside the IDLH awaiting for rescue and emergency extraction. Rapid Intervention operations should be deployed rapidly and should never warrant delay in acquiring equipment before entering an IDLH environment where a FF has been declared as "down" or unable to be accounted for, lost, trapped, disoriented, and/or incapacitated such as, but not limited to FFs unable to self-rescue.

The RIC should be fully equipped and ready to respond at a moments notice. In fact, not only does the instant invention not require the user to attend technician level training and certification to operate it, but it is designed to easily secure and package a downed FF without that FF's assistance in IDLH areas that are heat and smoke intensified to the point of limited to zero visibility where such emergency extraction equipment, such as the instant invention, is customized to accommodate the rescuing victim fully donned in firefighting gear, helmet and SCBA. Attaching complicated buckles and clips to each other in efforts of securing the FF to the device only to reattach additional harnesses and grab straps in order to drag the extraction device with the packaged FF out of the structure is difficult to perform and impractical in design for these emergency situations described as the ITIU. Some rescue operations will be too difficult to exit with the downed FF within one bottle of air supply where additional crews will have to replace the rescuers as they rotate to a Rehab area at the emergency scene. This is due to the labor intensity involved with RIC operations. The instant invention does not involve a plurality of complicated straps and buckles to secure a fully dressed firefighter for package and extraction. The instant invention incorporates a one system fits all, adjustable "2 Strap-2 Snap Buckle" system that can easily be applied while wearing bulky firefighting gloves in the low visibility, heat intensified environments of the ITIU.

Although NIMS is working on common terminology involving this emerging area of rescue art as well as the NFPA's efforts to standardize a short list of equipment to be carried by these rapid intervention crews such as a flashlight, radio, fire service rope bag, RIC bag, packaging device or board including other items not listed here, there still does not exist any standardized or customized piece of extraction equipment that is fast, compact and practical to the given environment. Full size backboards, stokes baskets, and stretcher devices are just too large and cumbersome for the task at hand so FF's usually refrain from using any of these pieces of equipment in a rapid intervention. It's a "find and drag out" type of operation. FFs are forced to improvise their own extraction device or equipment when tasked with "saving one of their own" in a RIC emergency deployment. One form of newly agreed upon standardized equipment is the fresh air spare bottle for the SCBA of the downed firefighter in case that FF's air supply is depleted. It has become the standard for these rapid intervention companies to have and to carry a rapid air transport (RAT) bag, which holds an SCBA bottle, and possibly an extra mask that is used to tap into the failed airline supply of the downed firefighter. This original RIT/RAT bag was invented by a firefighter initially, however, the term "RIT/RIC" Bag is now widely used and becoming the nationally recognized term when describing such equipment under the newest revisions of the National Incident Management System, NIMS. NFPA has also updated it's air standard under NFPA 1404 to comply with many such improvements including a Rapid Intervention Air System with a universal connection device or coupling called the UAC, Universal Air Connection, in conjunction with the Emergency Breathing Support System (EBSS). This means that the RIC Bags that Rapid Intervention Teams will be carrying into IDLH environments to save a downed FF will have to be included as a mandated piece of equipment carried by responding personnel. Making provisions for this is fundamentally absent in any prior art, whereas the instant invention not only provides for convenient and practical storage of the RIC bag when entering into the ITIU of the instant invention, but it also provides provisions for the RIC bag placement after the downed FF is connected to it and packaged for emergency exit. There are some examples of prior art such as Simione, U.S. Pat. No. 6,824,150 B2, which is later referenced in great detail and comparison further below, where provisions for the possible storage of a RIC bag and other stock piled equipment while traveling to the downed FF have been made. However, there is no provision for what to do with this mandated piece of emergency air supply equipment after it is hooked to the downed FF's face-piece. This, and prior art alike, fail to recognize the lack of efficiency and practicality of said devices that contribute to further complicate the rescue field of prior art.

The prior art in this field of rescue is so incredibly crowded that it's difficult to ascertain which device falls into which rescue category, whether be it technical, CID, military, or hospital transfer device, it is agreed that there is no such rule for titling one's device into the correct category of use or rescue art. There are compact stretchers, drag sheets, flexibly rolled up back-pack devices, drag rescue straps & harnesses, cervical spine boards, patient transfer mats, immobilization sleeves, technical rescue sleds, stokes & litter baskets, cylindrically stored longitudal drag boards and victim evacuation envelopes to name some examples. There are only a select number of examples of prior art that apply to the ITIU of the instant invention and therefore referred to herein.

U.S. Pat. No. 6,871,368 B2 to Calkin covers the shortcomings of many examples of the prior art very well. These examples are incorporated herein by reference to Calkin. Although, Calkin's reference to prior art including some of his own prior utilities, encompasses a portion of the rescue art that does not apply to the ITIU of the instant invention, they are an effective means for extricating persons out of unsafe areas to safe areas none the like. However, Calkin's own shortcomings exist primarily in the fact that his Emergency Drag Stretcher has no provisions for the shape of a rescuing firefighter wearing full PPE (Personal Protective Equipment) including SCBA. The new Air Standard under NFPA 1404 clearly results in the rescuing firefighter as well as the firefighter to be rescued keep his/her air pack breathing apparatus on so the size and posture of the firefighter with the air pack donned would prove to be ineffective for packaging into Calkin's device. Calkin's Emergency Drag Stretcher also has a plurality of straps, buckles and attachments resulting in seven separate points of attachment. Although this system packages a non-SCBA wearing victim quite snugly, the practicality of deploying it by firefighters functioning in the rapid intervention capacity while wearing gloved hands and full PPE in the described ITIU where the visibility would be poor to zero quality and the heat would be too intensified to remove such gear to improve dexterity, further proves how limiting and inapplicable the device would be for rapid intervention operations. Furthermore, Calkin's Emergency Drag Stretcher is not designed to move seamlessly inside the confines of a burning structure by a limited team of rescuers in a limited space environment according to the location and arrangement of the carry handles on the dorsal and lateral sides as well as the rigidity of the full body design. Turning corners, and being pulled through debris-ridden hallways may require the usage of a low profile means of extraction. Firefighters carry a fire service rope as part of the required gear recommended by NFPA for crews that are functioning as the RIC where no such attachment or provision was made to Calkin's drag stretcher that would accommodate this basic tool that firefighters use to extract downed firefighters from the interior of a structure. Most importantly, Calkin's drag stretcher is without the intent and provision in design that both the rescuer and the victim to be rescued will be in full firefighter gear for the ITIU of the instant invention. The instant invention, F.R.E.E. Sled, allows for both the rescuer and victim to be in full firefighting gear including SCBA. The F.R.E.E. Sled also presents with a simple strap and harness system that entails a Twin Strap-2 Snap Buckle method to secure the victim instead of the plurality of straps seen in many prior art including Calkin's drag stretcher. So although Calkin's Emergency Drag Stretcher has significant shortcomings when applying it to the ITIU of the instant invention, Calkin does cite two other references that do apply to rescuing occupants inside an ITIU that would be similarly described for the instant invention. For this purpose, we will refer to Landes and later Fee/Fee/Haskel/Haskel/Harty & Harty separately in efforts to describe the shortcomings of each.

U.S. Pat. No. 5,787,529 to Landes describes a Rescue Carrier Device that facilitates removal of victims as well as carrying in equipment that might be applicable to operating firefighters. However, Landes own shortcomings exist in that the person being rescued cannot be packaged wearing a firefighter helmet since the carrier does not provide the room for one. Furthermore, given the ITIU of the instant invention, Landes' Rescue Carrier Device does not provide for the victim to be wearing a backpack-mounted SCBA and therefore the victim has to have this air-pack ensemble removed prior to extrication. Current NFPA standards eliminates the need to remove SCBA due to the most recent air standard enhancements including a Rapid Intervention Bag comprising spare SCBA bottle supply with the EBSS (Emergency Breathing Support System) and UAC (Universal Air Connection) by means of a universal port or connector. Landes' carrier device does not allow the provision to include this piece of equipment since there is no place for the RIC Bag to go. Firefighters commonly place these RIC Bags between the firefighter's legs so that during evacuation, the victim does not become separated from the connected auxiliary air supply or by means of this airline inadvertently tugging or removing the FF victim's face-piece. This is not the most practical measure unless the bag can be secured to the FF somehow since the bag has a tendency to drag alongside or behind the victim. This, however, confirms the need for improvement in this rescue art concerning this component despite the fact that prior art, including Landes's Rescue Carrier Device, has not done so. The Rescue Carrier Device by design and location of the lower extremity straps originating and terminating at the distal end of the device eliminates the possibility to have a formidable foundation to which to place any life saving breathing apparatus between the firefighters legs since it is likely to fall right between the victim's legs causing it to be either left behind or pulling on the hose that is attached to the firefighters facemask and regulator. Having terminal and attached ends amongst a plurality of straps and buckles leads to potential confusion since it's intended to be operated within the confines on the ITIU of the instant invention. Landes' device provides for at least four straps and buckles requiring the rescuer to meet four separate means of attachment to accomplish the task. The instant invention, F.R.E.E. Sled has a built in location to store this RIC bag while proceeding to the downed FF and/or victim location as well as a color coded Velcro strap specifically for the security of this RIC bag once the victim is loaded and ready for emergency extraction. (See FIG. 1 for RIC bag security strap 24) To date, there has not been an introduction of an emergency device that has provided for this critical component until the innovative design of the F.R.E.E. Sled.

The instant invention, F.R.E.E. Sled, counteracts this problem regarding the plurality of straps and attachments in many prior art devices. FIG. 1 also shows the F.R.E.E. Sled depicting a built in victim harness 22 in a closed loop that makes up the shoulder strap system. These Victim Harness shoulder straps 22 only have two points of attachment where an adjustable pull-tab 35 to the strap terminates at a single fixed clip & cam system 38 in order to secure and package the victim as referenced in FIG. 1. The fewer quantity of straps and buckles to meet and attach, the quicker, easier, safer and overall more successful the operation is likely to become.

Additionally, Landes' Rescue Carrier Device does not make provisions to be integrated with any other piece of essential equipment. Firefighters are constantly being challenged with an assortment of tools & equipment to carry inside the building with limited staffing to carry them. Integrating the equipment in a practical manner for the entrance of the rescue team into the environment is just as important than providing a means to place, secure, and incorporate this equipment for the emergency exit. Victims usually occupy the space within the device where these items were stored initially if stored within the rescue device. Landes' Rescue Carrier Device provides no such consideration nor does the prior art accomplish this provision successfully for that matter. Landes does make reference to the prior art including citations to U.S. Pat. No. 4,442,557 to Clemens where a flaccid material was developed for carrying fire hose and equipment including personnel. Clemens, like Landes and the prior art, neglect to construct an efficient and practical means of packaging downed firefighters specifically when the full ensemble of protective garments including SCBA remains on the victim.

Another reference cited in Landes pertains to a specific firefighter rescue harness and therefore, deserves a closer look. US Patent 2007/0192926 A1 to Fee/Fee/Haskel/Haskell/Harty and Harty, referred to as Fee/Haskel & Harty for the purpose of abbreviation, is a Rapid Intervention Rescue Harness. Recent updates to *NFPA* 1971; *Standard on Protective Ensembles for Structural Fire Fighting and Proximity Fire Fighting* 2007 *Edition*, require the addition of a built in Drag Rescue Harness or DRD into the inner lining of the firefighter's turnout coat. This improvement validates and recognizes the need for rapid firefighter rescue and extraction from IDLH atmospheres within the ITIU of the instant invention. The, now standard issue, DRD within structural protective firefighting coats has some shortcomings of it's own, however, if utilized correctly can be a tremendous advantage to loading the firefighter onto the instant invention, F.R.E.E. Sled. The instant invention, although more effective than any other device in the art including the DRD, is not designed to replace the built in drag harness since the DRD does not address any of the extraction complications that have been referenced regarding rapid interventions of the ITIU. Firstly, the Rapid Intervention Rescue Harness and other DRD's alike are limited in the successful deployment of the straps depending on whether or not they were re-installed properly. The DRD in design, although originally installed by either the department taking ownership or the manufacturer, have no bearing on the correct position, and alignment at the time of potential application if the firefighter has had to remove the harness from the coat post inception. Reasons for removing the harness is primarily due to prepare it for laundering the coat and the three protective layers. Per NFPA 1971, bunker gear turnout coats shall have three main layers consisting of an outer protective shell, a moisture barrier creating a mid-layer that serves as a dead space for air, and a thermal barrier that comprises the innermost layer that rests against the firefighter's body directly. It is in this mid-layer between the interior surfaces of the outer shell garment and the moisture barrier surface that the DRD is strategically placed into position as to form a harness in the configuration of a loop around the firefighter's underarm. This looped webbing material extends upward to the midline area just below the posterior portions of the topcoat collar. Here the closed loop meets a point of termination to each other so that operating firefighters may open a protective flap therefore accessing the DRD in one quick motion. NFPA 1971 also makes strong recommendations on the laundering of this structural firefighting gear to include situations such as; after every use at a fire, when exposed to bodily or bio hazardous fluids or materials, when it is visibly dirty, and at least once a year to name a few. Each one of these occurrences warrant a removal of the DRD in order to separate the linings of the coat in preparation of the laundering process. So it is this continual occurrence of placing and replacing the DRD back into the jacket liners that pose the critical missing link. Are they being installed properly? Most firefighters agree, that accessing the DRD harness grab handle from the coat pouch in a zero visibility environment while maintaining the required protective firefighting glove on was difficult to accomplish. Wearing the required SCBA air-pack on top of the new 2007 compliant turnout coat also posed some discomfort for working firefighters especially around the armpits and shoulders as well as increased the tension and friction on the harness when FF's were lying on their back creating a difficulty to deploy the handle in one quick motion as result. Firefighters are having to resist modifying the looped harness to be positioned lower in the coat due to the discomfort while sacrificing a less than desired deployment because of the lower positioning of the harness. Depending on the manufacturer the inner harness can be made of rope or a flat section of webbing, which would increase or decrease the level of discomfort for the firefighter wearing an SCBA. Of course like any other new revision to the fire service, training with the new equipment is essential to the application in the real emergency. Many firefighters have discovered that the interior portions of the thermal & moisture barrier liners are taking on significant wear to the point of being taken out of service due to the newfound friction and abrasion points from these harnesses especially when put to use in drags, carries, and extraction exercises. These DRD harnesses are constantly being upgraded to meet the challenges that arise from feedback of the field fire fighters, however, the inherent design of the harness still remains the same. The method of rapid victim removal with these systems can be a useful tool in loading or positioning the victim into the instant invention, F.R.E.E. Sled in preparation for rapid emergency egress. A downed firefighter to be rescued by either one or two firefighters or more involves the application of dragging the firefighter on the back usually in the "head forward" or "head first" method. This position of drag places the firefighter's air bottle and SCBA harness in the "bottle down" position. Having the SCBA bottle and the newest generation air packs including the additions to the posterior of the pack such as the new Personal Alerting Safety System (PASS) alarms containing rear facing visual and audible features invite more opportunities for potential entanglement in the debris ridden floor areas of the ITIU of the instant invention. *NFPA* 1852: *Standard on Selection, Care, and Maintenance of Open-Circuit Self-Contained Breathing Apparatus (SCBA)*, 2008 introduces the new standard that requires the PASS Device alarm to be mounted and audible from the front as well as the back in case a downed FF was incapacitated and laying on top of his/her front mounted PASS alarm. When it comes to dragging a FF out of the structure it usually means the FF goes in the head first position while lying in the supine position. Supine for the victim also means that the bottle surface will meet the ground and drag amongst it. LODD reports released from NIOSH where the discovery of entanglement issues for trapped interior firefighters have been noted, also involve the commonality of the SCBA and more specifically the bottle yolk and attachment areas to be prone to contributing in such entanglement. The bottle yoke is the threaded stem piece that projects downward and involves the air bottle supply on/off knob. The SCBA is a critical piece of equipment with new standards recognizing the need to not remove the FF's air pack and supply to merely facilitate a firefighter rescue. Providing such measures as to confine and position the SCBA bottle out of the exposure potential zone where entanglement prone obstacles could interrupt the emergency egress. Newer brands of 2007 compliant air pack systems such as Sperian and Survivair are developing air pack systems that allow a gap or space to run between the air pack back-plate and the bottle creating a void for entanglement hazards such as wire, coil and cord to snag up and bind between. It is important that we find other means of dragging downed FFs out of buildings before resorting to drags that involve the victim's air pack bottle to be facing downward such as the preferred method of DRD usage and application. The F.R.E.E. Sled provides a means of confinement of the victim's SCBA bottle during the emergency extraction and therefore eliminates the potential of the SCBA bottle becoming entangled with any obstacles within the ITIU of the instant invention. Another critical piece of equipment for firefighters where removing it to facilitate a rescue removal is not an option nor would it be a measure that one would consider, is the top front piece holder of a firefighter's helmet. This front piece holder is usually in the form of a brass eagle and it protrudes to the top ridgeline of a firefighter's helmet extending further to its highest point of extension. This front piece holder arrives at a point that was originally designed to break a glass window in an emergency exit. Because of this pointed edge that clips over the top of the front piece holding it in place it makes it prone to entanglement while operating in the confines of an IDLH environment such as an interior structure fire. Again, not providing for the reduction of entanglement while facilitating a rapid firefighter emergency extraction leaves the exit plan incredibly flawed in design. To package the firefighter rapidly in such a way that operational level personnel can effectively apply the device while providing for the enclosure of the entanglement prone areas of the downed firefighters PPE, such as the bottle and fire helmet front piece holder, means that the emergency egress stands a better chance of success resulting in the better chance of victim and rescuer survival. The F.R.E.E. Sled provides for the confinement of the FF victim's fire helmet with a recessed area to facilitate this with profile reduction helmet seat via recessed helmet well 5 as well as left & right entanglement protection wing guards 7 to the lateral sides of the F.R.E.E. Sled's head board shown in FIG. 5. The DRD as well as the crowded field of prior art neglect to address this issue of reducing the entanglement prone components of the intended victim's PPE effectively and with practicality in mind since these methods mostly revert back to the traditional means of dragging a firefighter in the "head forward" position while laying on his/her back, furthermore exposing the air bottle downward to the debris zone of the floor area while at the same time allowing the head, and more specifically the top helmet of the downed firefighter to move freely in the unsecured position free to snag or entangle on the myriad of obstacles that make up the floor of the ITIU of the instant invention.

U.S. Pat. No. 7,302,723 to Michael Joseph Dean is a Fire Rescue Belt. This belt, like many examples given in the prior art, does not address this entanglement issue for downed firefighters or what rescuers will have to overcome in order to get out safely. In fact, the design of the webbed netting of the strap pouch itself is prone to snagging up on these obstacles or a piece of gear on the firefighter's exterior. Most firefighters incorporate a 6'-8' piece of 1" webbing in their arsenal of pocket survival tools. When these pieces of life saving equipment are configured in a closed loop secured with a water-knot they become a basic yet effective emergency rescue device in its primitive form. Even stated, they still do not address the entanglement issues present within the confined interiors of the ITIU. Dean's Fire Rescue Belt is not addressing the shortcomings of prior art or these entanglement issues since it also causes the firefighter to be dragged bottle-down with an unprotected helmet free to entangle on the exiting debris within the ITIU of the instant invention, F.R.E.E. Sled. Simply put, Dean's Fire Rescue Belt is little more effective than a 6' piece of pocket webbing when it comes to FF emergency extraction operations.

Further studying the overabundance of devices in this grossly generalized field of prior art is a challenge to make the fair and appropriate comparison analysis since so many devices fall into so many different subcategories. Clearly the instant invention has set itself apart from all the hospital based stretcher and patient transfer boards as well as the cervical spine immobilization devices that do not apply to the ITIU of the instant invention. The technical field of rescue that is strictly regulated to the technician level rescuer further complicates the field from what the operations level equipment should feature and what would be out of the scope for the intended user without proper certification and training on the particular device. One device does in fact address some issues discussed above to the level not mentioned previously.

U.S. Pat. No. 6,824,150 B2 to Jason Simione is a Cart for Transport of Personnel and Material in a Hazardous Environment. Simione's cart, unlike the crowded field of prior art, provides a design that would facilitate a firefighter's SCBA bottle from a packaged firefighter wearing full PPE and air-pack breathing apparatus. The cart provides for the victim's SCBA bottle once a downed firefighter is packaged and it provides the room for a RIC bag to be stored on the way in to locate the victim. Although Simione's cart has provided two specific areas that the instant invention, Firefighter Rapid Emergency Extraction device, provides more efficiently, there lies a host of shortcomings in the applicability and practicality of the cart's design that cannot be overlooked. The cart is designed with a series of wheels on the bottom for navigation over uneven terrain. The interior environments of the ITIU of the instant invention are the same-targeted environments that Simione's cart claims to be used in. Unfortunately, the wheeled underbelly of such a cart would prove immobile once navigated through the soot, ash, and charred debris ridden areas of the floors located within the ITIU. Some of the causes of debris include smoldering furnishings, carpeting and products of partially burned resins, plastics and rubberized materials that tend to be located amongst the floor areas of the ITIU. Items tend to fail and fall from above including ceiling tiles, electrical wiring and HVAC system duct coiling which all prove to be present on common floor areas within interior structure fires especially those environments where a firefighter is down requiring intervention as previously stated. Simione's cart states a Confined Space version of the cart, however, since the victim goes on top of the cart assembly and not completely inside, there lies the issue of the firefighter not being placed in the lowest possible profile or position. Even in Simione's standard version of the cart, the victim still remains on top exposing their entanglement prone gear to the probable objects that could snag upon it while making emergency exit and extraction. In addition, the victim is exposed to a higher than ground gradient elevation while further allowing for potential complication if a failure exists with the victims face mask, regulator or breathing apparatus. Firefighters are taught to stay as low as you can since the products of superheated smoke and gases tend to rise above the ground floor causing the coolest air to exist on the floor and the highest heat at the ceiling. Not providing for the lowest profile for a victim despite the fact that rescuers will have to maintain this low profile as well is an inherent oversight of the said Cart for Transport of Personnel and Material. Furthermore, the handle on which to grab the cart is positioned into 4 locking positions depending on where the rescuer is pulling from. Due to the limited mobility of those locking handle positions, this allows a rescuer to pull or push the cart from a comfortable upright standing position, unfortunately a position that rescuing firefighters seldom find themselves in due to the nature of their work and the heated conditions that involve their profession while working in these IDLH areas. Operating Simione's handle in the upright standing position prevents the rescuing FFs to be in a low profile, crouched down and sometimes crawling position throughout the structure while arriving to and removing victims from the area of highest hazard. Additionally, due to the high profile packaging position of Simione's cart, it is not easy to load an unconscious or un-ambulatory firefighter from the floor to the top mounted position of the cart so that the SCBA bottle is fitted and received into the bottle well area, without lifting the FF straight up into the semi-fowlers position or without loading the downed FF or victim from the head-first position or top of the cart. The modern firefighter has up to 100 lbs. of gear that adds to the weight of the victim firefighter as well. It is cases where arriving at a downed FF from the foot-first end in a narrow hallway or in a closet or where a FF butts up against a wall area that would further complicate the quick loading application of such a cart. The instant invention, F.R.E.E. Sled, can be applied from any top, bottom, lateral or feet first position. Although it may seem like strolling a firefighter on a cart and wagon down an uneven but smooth terrain is as simple as it looks, the probability of accomplishing this within the confines of the ITIU are highly unlikely since this floor area of the ITIU is anything but smooth. The storage capacity of on duty fire apparatus in order to properly stock Simione's cart so that it is available at the fire scene would not accommodate such a large cart. Relying on a specialty vehicle to bring the extraction device to the scene is exactly what this emerging field of rescue needs to change and improve upon. The instant invention, F.R.E.E. Sled, folds down into a slim storage dimension of only 11" in depth, 51" long and only 21" wide allowing it to be stored on every fire engine, rescue vehicle, ambulance or chief's vehicle in the country. The cart also is dependant on whether or not the FF's legs and helmet are balanced on the handles of the cart itself. Once a downed firefighter gets loaded and balanced on the cart handles with a snugly fitted SCBA bottle into the cart, it is not likely that the wheel design will just coast over every bump and obstacle without any snags since a shift in victim positioning would create the forward tipping motion to dump the victim off the cart top. The cart's inherent design to tip is what aides the ease of loading a victim onto it making the cart prone to also dumping or tipping once loaded with a victim if it becomes off balanced. Simione's cart also does not provide for a proper package of the firefighter's head since the head position is dependant on whether or not the firefighter's helmet is of certain shape, design and position where it can be slid back creating a cradle that the victim's head will support. The same handles on each end of the cart that support the firefighter extremities also support the head and helmet if kept in place. Of course with the handles extended and in the supporting position for the victims lower and upper body portions, the versatile arrangement of handle positions are no longer an option since the handle must maintain an even plane with the top ridge of the cart in order to facilitate the victim package position and head/helmet support. If the firefighter's helmet is knocked out of position from merely resting on top of the handlebar, then the firefighter's head is also no longer supported which may cause the cart to become top heavy resulting in the head of the cart to dip downward into the hazards of the debris ridden floor area of the ITIU. This bumping out of the helmet position can also injure the firefighter's head and neck since the helmet only rests passively on the handle requiring the weight of the victim's head to secure it in place. The helmet position is critical in facilitating this headrest position although it is not a recommended means of wearing the FF helmet since it does not offer the thermal and impact protection to the FF's head while inside the environment deemed or suspected to become IDLH. Many firefighters have helmet mounted flashlights, wood chocks, specialty tools and gear-sets placed around the top ridges or brims of their fire helmet. This can also pose a problem with the helmet not resting within the limited space provided within the set handle. Sometimes the firefighter has been injured to the point that the fire helmet has been knocked off and therefore not presently available at the time of firefighter packaging. In this case Simione's cart would not allow a safe and rapid removal without the helmet in place to support the head since the helmet itself supports the victim's head and not the open web design of the handle. It is the helmet that passively sits atop of the handle cross-section once slid backward off the FF's head leaving the FF unprotected from any of the hazards of the ITIU.

Often times while trying to navigate the victim through tight corridors and sometimes narrow spaces there will be forces applied to the lateral ends of a victim during rescue that in this case could result in tipping Simione's cart since the wheels do not pivot in a 360 degree position or move from their fixed straight forward position. The cart itself has a rigid frame that is unforgiving in those tight and narrow spaces often found in the ITIU of the said IDLH atmosphere.

As mentioned earlier, *NFPA* 1852: *Standard on Selection, Care, and Maintenance of Open-Circuit Self-Contained Breathing Apparatus* (*SCBA*), 2008 *and NFPA* 1404 introduces the new standard that requires the PASS Device alarm to be mounted and audible from the front as well as the back. The rear mounted audible alarm boxes add to the body mass and configuration of the rear side of the air pack apparatus. For these reasons the new generation air packs may not fit completely into Simione's cart since the shape and profile of the bottle and pack are different than the type described in the device description in the patent. These rear-mounted modifications have changed the rear profile of the pack and harnesses, which sit adjacent to the bottle sides from the dorsal view. Furthermore, Simione references the Scott Air pack by name several times however, the cart is suspect to not fit many other types, shapes and sizes of SCBA since it specifically states the Scott air pack bottle and no other brand name. Scott air-packs are known to be compact with a rear facing slim and narrow design where as new generation air-packs are anything but slim and narrow.

Simone's cart boasts the fact that the cart has a waterproof compartment that could protect the stored tools from getting wet while providing foam into the cart design that could enhance the buoyancy of the cart allowing it to float amongst flood filled floors within the structure fire environment. According to Simione the cart provides enough tool storage capacity for what 5-15 firefighters would have had to carry. With these standard features of Simione's cart placed into realistic practice would cause the fully loaded cart of tools and storage to not float in any flood filled area, nor would it allow the cart to float after placing a wet, heavy and unconscious or un-ambulatory firefighter on top of it. In fact each firefighter has a set position in fire-ground operations with each position relevant to a specific task responsibility. With that specific task responsibility comes a specific tool assignment and most fire service organizations will in fact title those positions that are specific to that relevant tool. For example, the firefighter that is responsible for extinguishing a fire with a fire hose will be called "the nozzle person" and a search company member who moves about the structure without a charged water line in place will carry a 2½ gallon water extinguisher. That firefighter's title is known as the "Can Person" which is short for "water can". Truck company personnel carry large roof hooks and the title for that roof-operating member is called "the Hook". Some members are responsible for forcing the doors within a structure with heavy forcible entry irons so crews can gain access inside to perform fire attack and search operations. The member responsible for this task and who would be carrying this set of heavy metal tools is called "the Irons or Irons Person". During Rapid Intervention Responses there are a lot of tasks to consider and with that, a lot of responsibilities in relation to the corresponding tools and equipment that will be necessary to not only mitigate the response but to also enter and travel to the downed FF. The very basic tools are the Rope Bag, the Water Can, the RIC Bag and the Irons. Even if the response team is not well organized, these basic tools will still be needed to enter the structure and would not be practical to have them stored inside a cart such as Simione's. It is not practical to bring a sled full of equipment that 5-15 persons would have to carry only to have a team of members carrying nothing. Each member would have to assemble at the cart upon arrival at the destination inside the heat filled, low to zero visibility environment so that they can empty the arsenal of tools from the loaded cart in order to provide room to load the victim inside. This creates a pile of crewmembers at the cart sifting and sorting through the pile of equipment not to mention that the tools are needed in order to safely enter before effectively searching to the firefighter's last known location. The only practical piece of equipment that should be stored inside or with the device is the one thing that is not needed in order to enter and safely locate the downed FF nor is it something that should leave the FF's side once the victim is packaged inside the extraction device for emergency egress. That piece of equipment would be the firefighter air supply bag or RIC bag. Not only will the RIC bag containing the air supply system need to be with the packaged equipment so that the firefighter can be placed on the breathing apparatus, but also the RIC bag will need to stay with that firefighter once packaged since the connected air hoses are limited in length. The best place to store these RIC bags after victim packaging is between the legs of the firefighter. Simione's cart mentions the fact that the cart design provides room for a stored Scott SCBA cylinder while traveling to a downed firefighter and it mentions that the bottle well space provided will also serve to fit the downed firefighter's Scott air pack bottle once the victim is packaged. What Simione's cart design does not provide for is where to place the RIC bag and bottle once the firefighter is found and packaged. The cart design only provides for a top mounted position for the firefighter and the legs of the victim are passively rested on top of the foot end handle of the cart. Any further weight to the cantilevered style of the handle and how it projects outward from the cart foundation further proves how an air supply bag or bottle would not be a practical addition to this handle loading area. The handle does not provide the space or security for a bottle to rest without falling off. Placing it on top of the firefighter's trunk not only dead loads the victim on his/her torso, limiting the amount of breathing expansion, but it also creates an even higher center of gravity for the top loaded air pack. Placing the fresh air bottle supply or RIC bag on top of the firefighter torso that is already on top of a high mounted cart could cause the bottle to fall off the side possibly pulling the face piece and breathing regulator off the firefighter's air mask. This bottle could also fall through the handle or get wrapped around the cart or wheel system further creating it's own entanglement issue. The priority of the response team or rapid intervention crew is that they bring the mandated air supply unit with them and that it stays with the victim in case it is needed. If the victim is connected to the air supply apparatus then ensuring that the hoses do not become separated from that connected air supply unit or tear the facemask off the victim is paramount. Simione's cart design ignores these practical details unlike the provisions taken with the design of the instant invention, F.R.E.E. Sled where a stored yellow Velcro RIC Bag Security Strap 24 is sub-attached to a color coded lower extremity strap 26 in order to rapidly apply it around where the RIC bag would be placed (see FIG. 1).

There have been studies performed and documented by NIST that it takes 12-15 firefighters to rescue one single firefighter that is either unconscious or un-ambulatory. This ratio is partly due to the labor intensity of the mission of seeking, packaging and extracting the downed firefighter and does not take into account that there may be wall breaching or many other components involved to facilitate the rescue. Unfortunately, the prior art explained above consists of inefficient equipment that is either inapplicable to the given scenario or impractical in design for the operation at hand.

It is an object of the instant invention to add several novel changes and easy to apply improvements for the operational level rescuer that currently do not exist in the typical field of prior art involving such rescue devices. It is important to emphasize that the instant invention, Firefighter Rapid Emergency Extraction device or F.R.E.E. Sled focuses on victim removal and not merely another patient transfer device that seems to further complicate the present overcrowding field of prior art. The F.R.E.E. Sled offers the benefits of a technical piece of equipment with the M.A.R.C.-8 hardware, mechanical advantage revolver clip & figure eight anchor system on both the head-board and foot ends of the device by means of using a standard issue fire service rope and without complicating the equipment with the technical components of a system that involves pulleys, block, tackle and technician level training and/or certification to operate.

Lastly, there is one additional consideration that has not been addressed by any prior art thus far. Often firefighters requiring rescue are not on the ground floor of a structure and a rapid intervention is called for on the $2^{nd}$ or $3^{rd}$ floors of a structure or above. Fire service ground ladders are placed to windows at these levels as a standard operating procedure. These ladders are there for a secondary means of egress so that interior firefighting crews are not forced to travel down the interior staircase to avoid a hostile fire event if an emergency exit situation exists. Firefighters are taught as a basic skill to perform emergency egress procedures out a window down a fire service ground ladder. This scenario is known in the rescue art as a "Firefighter Bailout procedure" or "Ladder Bail". Firefighters are also taught how to take fire victims down ground ladders as well as rescuing firefighters out of windows in those emergencies. The instant invention, F.R.E.E. Sled, allows a basic fire service rope or personal escape rope to be slung through the M.A.R.C.-8 hardware 60 or 62, via gated mechanical advantage revolver clip system 103 depicted in FIG. 12, so that the victim can be safely lowered down a fire service ground ladder without any modification, repackaging or reconfiguration to the victim package. In fact the instant invention, F.R.E.E. Sled has a predetermined dimension built into the baseboard of the design that allows it to lock in between the standardized rails of fire service ground ladders so that the victim can be brought down manually or lowered down the ladder from a rope either from the exiting window or safely from the ground below. FIG. 3 & FIG. 4 show the dorsal end exterior of Rescue Board 10, specifically labeled as dorsal mid-plate exterior 16 having the precise dimensions for the (left & right) Ladder seat dorsal runner rails 17, just parallel to dorsal mid plate exterior 16 allowing the F.R.E.E. Sled to slide on top of the ladder rungs while sitting inside and in between the raised rails of a typical fire service ground ladder.

It is not practical to suggest that a bulky, cart carrying bucket like Simone's or a drag sling would safely remove firefighters from the environment of the ITIU, especially down a ground ladder, if the environment that the victim and rescuer alike are working in are not prioritized into the design of that rescue device. Lifting FF victims from the floor onto the upper sills of exterior windows is a labor-intensive task and having those victims on a rescue board that offers rigidity to the base is an incredible advantage. In fact, the rescue board 10 has inboard handle grips (shown in FIG. 4 as item 75) on the sides as well as beneath the dorsal side (shown in FIG. 4 as items 33 & 34) of rescue board 10 to assist the rescuers in carrying and loading the victim onto the sills of windows or amongst the debris ridden piles of the floors amongst the ITIU. The instant invention has many features that maximize the life saving potential of the device so that firefighters working in their environments can carry it into the ITIU and integrate it with presently assigned tools and equipment. This is easily accomplished without the complicated plurality of harness straps and buckles where the rescuer has to remove their bulky protective firefighting gloves in order to secure and remove the victim with an easily created mechanical advantage system while maintaining the lowest profile possible for the rescuer and the victim alike. The F.R.E.E. Sled provides for the fastest, safest most efficient means of removing a victim from a hostile fire environment with the same level of effectiveness whether extracting victims out the front door at grade level or lowering down a fire service ground ladder from a multi-story window regardless of the head-first or feet-first position of the victim package.

BRIEF DESCRIPTION OF THE DRAWING

Many aspects of the present disclosure can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views. The several figures of the drawing, in which like designations denote like elements, are representative only and do not appear as limiting in any way.

1. Firefighter Rapid Emergency. Extraction Device

Figure 1:
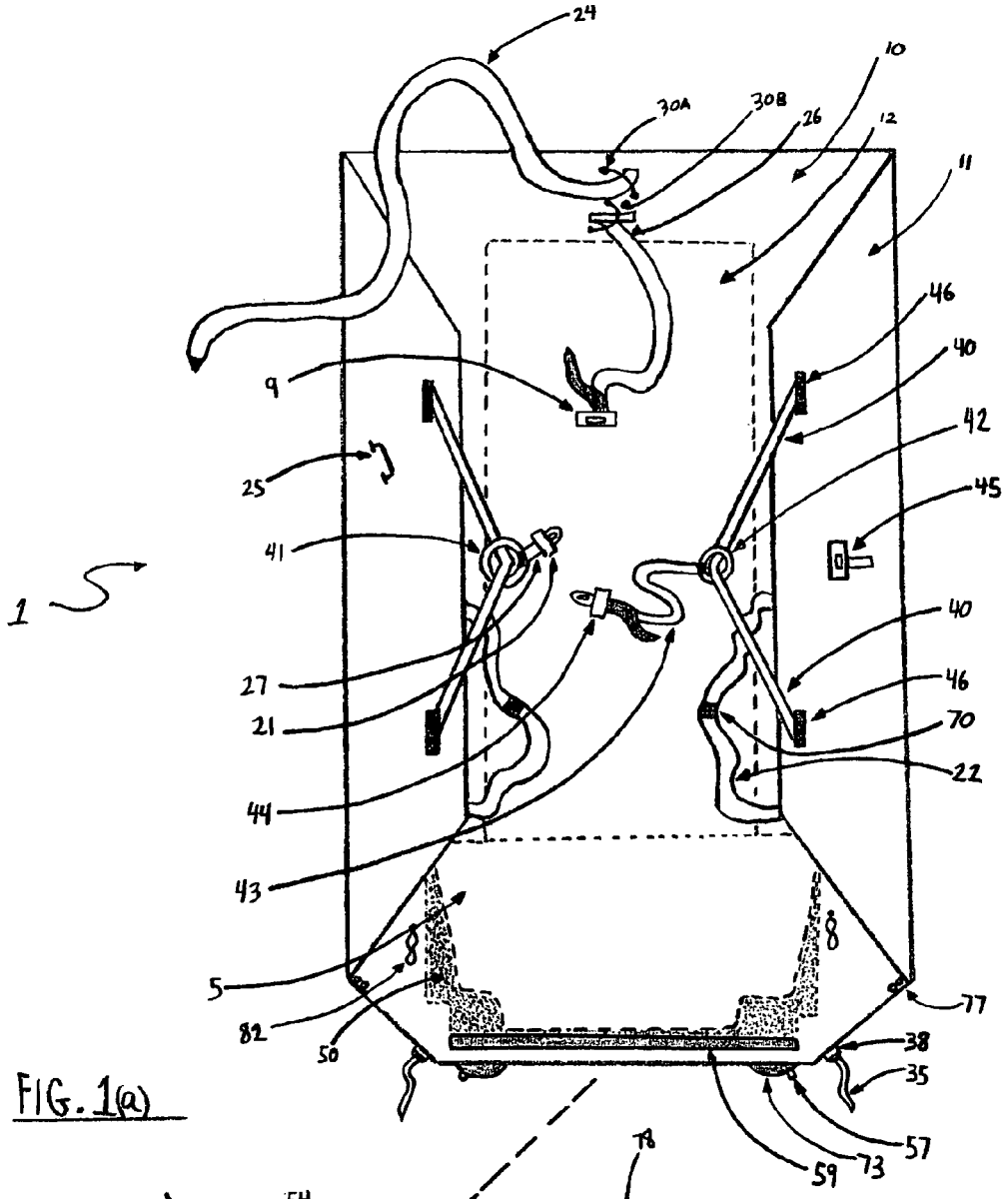
Figure 1A:
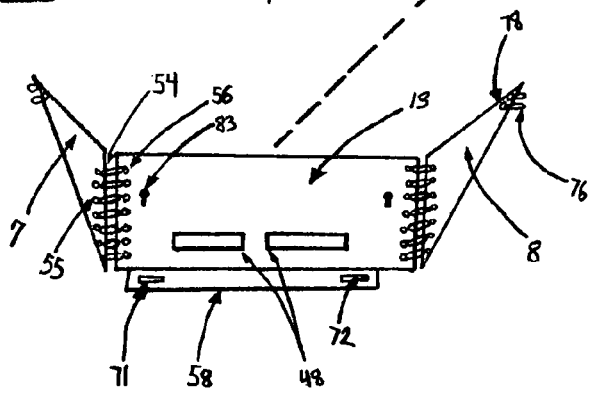

2. Male end of Velcro hold tab located on pull strap 35 just proximal to the terminated end and distal to pull strap locking clip & cam 38 which serves as attachment to terminated end strap 35 to be pinned up and out of the way via attachment to hold tab 3

3. Female end of Velcro hold tab preferably polygon shaped and located lateral to pull strap 35 & pull strap locking clip 38

4. Male end of pull strap 35 Velcro hold tab preferably located several inches from the terminated end of pull strap 35 designed to attach to Velcro hold tab 3, pinning pull strap 35 up and out of the way when in the loaded position

5. Profile reduction seat for recessed helmet well on superior portion of interior rescue board 10 preferably 12" wide across the top

6. 3" high headboard rigging plate for permanently attached MARC-8 hardware 60 (mechanical advantage revolver clip & anchor figure eight-60), Power Handle 31 & anchor points to sling strap 52

7. Left & right side rescue head board lateral entanglement protection wing guards preferably constructed of pliable soft-touch plastic composite

8. Superior end dorsal exterior rescue board 10 containing sub-board handle grip 34

9. Female seat belt buckle end of lower extremity strap 26 connecting to male seat belt buckle 21 at distal end of strap 27

10. Rigid Rescue Board preferably constructed of High Density Seamless Rotational Mold Polyethylene Plastic

11. (Left & Right exterior) Lateral Sleeves preferably constructed of Soft Touch Rubberized Polyethylene Composite

12. Recessed Bottle Well on Interior Rescue Board 10 preferably 32" L×12" W

13. Three dimensional adjustable Rescue Head Board at superior end of Rescue Board 10 also housing Sling Strap

14. lateral aspects of left & right exterior dorsal side wings projecting outwardly from angle of dorsal mid plate exterior 16 and the lateral sides of rescue board 10

15. Dorsal side exterior at superior end of rescue board 10 descending downward from inferior line of rescue head board 13

16. Dorsal Mid plate exterior beneath recessed bottle well 12 concaved in an outward dome between ladder seat dorsal runner rails 17

17. (left & right) 2" high ladder seat dorsal runner rails parallel to dorsal mid plate exterior 16 separated by an approximate distance of 15¾"

18. 3" high foot plate serving as the foot end rigging plate for permanently attached MARC-8 hardware 62 (mechanical advantage revolver clip & anchor figure eight-62), power handle 19 & Sling Strap 67

19. 6" wide aluminum bar grab handle fixed to Kevlar handle strap 63

20. (Left & Right interior) Lateral Sleeves preferably constructed of Soft Touch Rubberized Polyethylene Composite

21. Male-end seat belt buckle attached to distal end of 3" long strap 27 which completes lower extremity strap 26

22. (Left & Right side) Built in Victim Harness shoulder straps preferably constructed of 2" red tubular webbing

23. (left & right side) fixed terminated end of built in victim harness 22 attached to interior rescue board 10

24. 50" long fluorescent yellow 2" wide Velcro RIC Bag security strap

25. 3" wide change of direction bar for Velcro RIC Bag security strap 24, mounted on a 45 degree angle to left exterior lateral sleeve 11 preferably a fluorescent yellow color

26. Lower extremity strap positioned at the inferior end of interior rescue board 10 just proximal to RIC Bag security strap 24 and attached at superior end with female seat belt buckle 9 preferably 20" long×2" wide and green neon in color

27. 3" long 1" wide green neon webbing with fixed male seat belt buckle 21 attached

28. Metal grommets, preferably brass or stainless steel, aligned along the medial end of both left & right interior lateral sleeves 20 for points of attachment to rescue board 10 via compression bolts 47

29. Kevlar handle strap securing 6" wide aluminum bar grab handle 31 to rescue headboard rigging plate 6

30. (30*a*)=2" nylon elastic cord to secure RIC Bag security strap 24 in stored state (30*b*)=2" nylon elastic cord to secure 20" long extremity strap 26 in stored state

31. 6" wide aluminum bar grab handle secured with permanently attached Kevlar grab strap 29 at lateral ends, mounted on rescue head board rigging plate 6

32. Dorsal side exterior at inferior end of rescue board 10 descending downward from inferior line of foot end rigging plate 18 adjoining to dorsal mid-plate exterior 16

33. Superior end sub-board handle grips just proximal to where the superior end of dorsal mid-plate exterior 16 meets dorsal side exterior at superior end 15 to facilitate handling of the head end of rescue board 10 from the underside surface

34. Inferior end sub-board handle grip just proximal to where dorsal side exterior 32 meets the inferior end of dorsal mid-plate exterior 16 to facilitate handling of the foot end of rescue board 10 from the underside surface

35. (left & right) 6" long pull strap distal to pull strap clip 38 on lateral side exterior 15 preferably red in color

36. Velcro pouch to secure MARC 8 hardware 60 onto rigging plate 6

37. Left & right sided in-board subsurface strap channels for built in victim harness system 22 extending toward terminated end pull strap 35

38. Victim Harness adjustable locking clip & cam at distal end of pull strap 35

39. In-board subsurface strap channel entry point opening at proximal end of victim harness system 22

40. (left & right) self equalizing torso cross straps preferably 20" long, 1" wide and reflective silver in color

41. Stainless steel cross chest change of direction (C.O.D.) ring to receive cross chest tensioning belt 43

42. Floating solid stainless steel ring with fixed attachment to cross chest tensioning belt 43

43. Cross chest tensioning belt permanently attached to floating solid stainless steel ring 42 preferably 30" long 2" wide fluorescent orange

44. male seatbelt buckle at terminated end of cross chest tensioning belt 43 mounted on right side lateral sleeve exterior 11

45. Fixed seatbelt strap with female buckle to interlock with male seatbelt buckle 44 preferably 6" long, 1" wide, and fluorescent orange in color

46. Left & right row of grommets as terminated means of attachment for self equalizing torso cross straps 40 to left & right interior lateral sleeves 20

47. Vertically aligned compression bolts on left & right sides of medial edge interior lateral sleeves 20 further secured to metal grommets 28 as points of attachment

48. Split Velcro handle pouch mounted on rescue head board 13 forming a loop in the middle of sling strap 52 for easy access

49. In-board sub surface strap channel exit point opening proximal to victim harness adjustable locking clip & cam 38

50. 1" deep recessed storage seat for rescue headboard 13 when it is in the stored position which allows head board 13 to be laid across the top portion of profile reduction helmet well 5

51. dual storage pouches on left and right side of rigging plate 6 for storing rescue sling strap 52

52. 1" tubular webbing Sling Strap, preferably 12' long and gold colored, anchored at the sides of rigging plate 6 and horizontally stored inside left and right side storage pouches 51 extending upward to rescue head board 13 to form top loop via split Velcro handle pouch 48

53. Swing gate stopper just proximal to revolver pin 93 on revolver clip system 103 of M.A.R.C.-8 hardware (Mechanical Advantage Revolver Clip & Figure 8 Anchor System)

54. Kevlar/elastic flex-fit binding rings aligned vertically between rescue headboard 13 and lateral wing-guards 7

55. Metal grommets, preferably brass or stainless steel, aligned vertically on medial edge of lateral wing-guards 7 that serve as point of attachment for Kevlar flex-fit binding rings 54

56. Perforated holes vertically aligned on both lateral edges of rescue headboard 13 that receives Kevlar flex-fit binding rings 54 at proximal point of attachment

57. Left & right handle bar controlling manual slide crescent locks 69 positioned on exterior face of both left and right side manual slide wheel switches 73

58. Narrowed inferior end of rescue headboard base that drops down into rescue headboard base channel 59 during operational use preferably 1" thickness

59. Rescue headboard base channel that receives headboard base 58 during operational use preferably 1⅛" wide, 14½" long, and 2½" deep

60. MARC-8 hardware, a revolutionary design that combines a mechanical advantage revolver clip (MARC) & anchor ring in the form of a single figure 8 device for a 2:1 ratio permanently attached to rescue head board rigging plate 6

61. Nylon cord ring attaching MARC-8 hardware 60 to rigging plate 6

62. Foot end MARC-8 hardware permanently attached to foot plate 18

63. Foot end Kevlar grab strap attached to aluminum bar grab handle 19 at foot plate 18

64. Nylon ring securing foot end MARC-8 hardware 62 to foot plate 18

65. Velcro storage pouch for foot end MARC-8 hardware 62 mounted on foot plate 18

66. Split Velcro handle pouch for foot end sling strap 67

67. Foot end sling strap permanently attached to foot plate 18 preferably constructed of 1" wide gold colored tubular webbing×12" long

68. Dual storage pouches on left and right side of foot end plate 18 for storing rescue sling strap 67

69. The interior component of left & right manual slide subsurface crescent locks positioned horizontally and serving as the interior ends of slide wheel switch 73 from which it interlocks with left & right base-lock openings 71

70. Left and right side female Velcro hold tabs mounted on built in Victim Harness shoulder straps 22

71. Left & right rescue headboard base-lock openings that receive manual slide subsurface crescent locks 69

72. Rubberized base-lock bushings inside left & right base-lock openings 71 designed to offer stability to manual slide crescent lock 69 during operational use

73. Left & right raised manual slide wheel switches positioned just lateral to MARC-8 hardware 60 on head-board rigging plate 6

74. Left & right horizontal slide tracks preferably 1½" long, for manual slide wheel switches 73 to travel to and from the interlock position located on headboard rigging plate 6 just lateral to MARC-8 hardware 60

75. Left & right lateral handle grips placed just medial to metal grommet line 28 preferably placed 3" from the end edges of rescue board 10 aligned vertically with 3 on each side preferably 10½" from each other

76. Double Kevlar/elastic flex-fit binding rings aligned between rescue board 10 and lateral wing-guards 7

77. Double perforated holes aligned on both top lateral edges of rescue board 10 that receives Kevlar flex-fit binding rings 76 as point of attachment for lateral protection wing guards 7

78. Double Metal grommets, preferably brass or stainless steel, aligned on medial edge of lateral wing-guards 7 that serve as point of attachment for double Kevlar flex-fit binding rings 76

79. Left and right side male end Velcro hold tabs mounted on interior interior lateral sleeves 20 to receive built in Victim Harness shoulder straps 22 via female end Velcro holding tabs 70

80. Recessed seat for stored aluminum bar gab handle 31 on rescue head board rigging plate 6

81. Recessed seat for stored aluminum bar grab handle 19 located on foot end rigging plate 18

82. Left & right side Kevlar/elastic flex-fit ring loops positioned just lateral to recessed helmet well 5 that secures around rescue head board security posts 83 when in the stored position

83. Left & right side head board security posts positioned on the lateral exterior sides of rescue head board 13 that allow attachment of Kevlar/elastic flex-fit ring loops 82 when in the stored position

84. Male end (left & right side) lateral sleeve security snap positioned at the lateral midline edge of lateral sleeve 20 to receive lateral sleeve security snap 85 when in the folded ready position

85. Female end (left & right side) lateral sleeve security snap positioned at the midline medial edge of lateral sleeve 20 to receive lateral sleeve security snap 84 when in the folded ready position

86. Left & right side female end Velcro strips holding split pouch 48 in the upward/closed position on head board rigging plate 6

87. Left & right side female end Velcro strips holding split pouch 66 in the upward/closed position on foot plate 18

88. Lateral side exterior face containing pull straps 35 just lateral to head board rigging plate 6

89. Female end top snap buckle for M.A.R.C.-8 Velcro storage pouch 65 on foot plate 18 positioned to receive male end top snap buckle 90 when storing

90. Male end top snap buckle mounted on cover of M.A.R.C.-8 Velcro storage pouch 65 positioned to receive female end top snap buckle 89 @ foot plate 18 when storing

91. Female end top snap buckle for M.A.R.C.-8 Velcro storage pouch 36 on head board rigging plate 6 positioned to receive male end top snap buckle 92 when storing

92. Male end top snap buckle mounted on cover of M.A.R.C.-8 Velcro storage pouch 36 positioned to receive female end top snap buckle 91 on head board rigging plate 6 when storing

93. Revolver component serving as a revolving cylinder located at the base end of soft anchor-mechanical advantage ring 97 of mechanical advantage revolver clip system 103 which comprises the bottom half function of M.A.R.C.-8 hardware (Mechanical Advantage Revolver Clip & Figure 8 Anchor) systems 60 & 62 creating a 2:1 mechanical advantage when a piece of rope/webbing/strap material is pulled along side it

94. Screw gate component for swing gate 95 of soft anchor-mechanical advantage ring 97 of mechanical advantage revolver clip system 103 serving as a lock for system when in use

95. Swing gate to soft anchor-mechanical advantage ring 97 of mechanical advantage revolver clip system 103

96. Two Hinge bolts at articulating end of swing gate 95

97. Soft anchor-mechanical advantage ring serving as the gated ring & revolver component of mechanical advantage revolver clip system 103

98. Hard fixed anchor ring component comprising the top non-gated ring of M.A.R.C.-8 hardware (Mechanical Advantage Revolver Clip & Figure 8 Anchor) systems 60 & 62

99. Eight plate interface serving as the intersection of both anchor system 102 & mechanical advantage revolver 103 creating a case hardened surface of strength for anchor point attachment

100. Hard fixed connector ring at top of anchor system 102 serving as permanent attachment for M.A.R.C.-8 hardware systems 60 & 62 to both rigging plates 6 & 18 of rescue board 10

101. Spine of soft anchor-mechanical advantage ring 97 serving on the opposing side of swing gate 95

102. Fixed anchor system serving as the top portion and component of the M.A.R.C.-8 hardware (Mechanical Advantage Revolver Clip & Figure 8 Anchor) System

103. Gated Mechanical Advantage Revolver Clip System serving as the bottom portion of M.A.R.C.-8 hardware (Mechanical Advantage Revolver Clip & Figure 8 Anchor System)

104. Male end Velcro tab for M.A.R.C.-8 velcro storage pouch 65

105. Female end Velcro tab on foot plate 18 to receive male Velcro tab on M.A.R.C.-8 velcro storage pouch 65

106. Male end Velcro tab for M.A.R.C.-8 velcro storage pouch 36

107. Female end Velcro tab on headboard rigging plate 6 to receive male Velcro tab on M.A.R.C.-8 velcro storage pouch 36

200. Metal carabineer depicted in FIG. 14 for illustration purposes (not part of the instant invention) further depicting a hard anchor system via fixed anchor ring 98 and intersecting figure-eight plate interface 99

Figure 12:
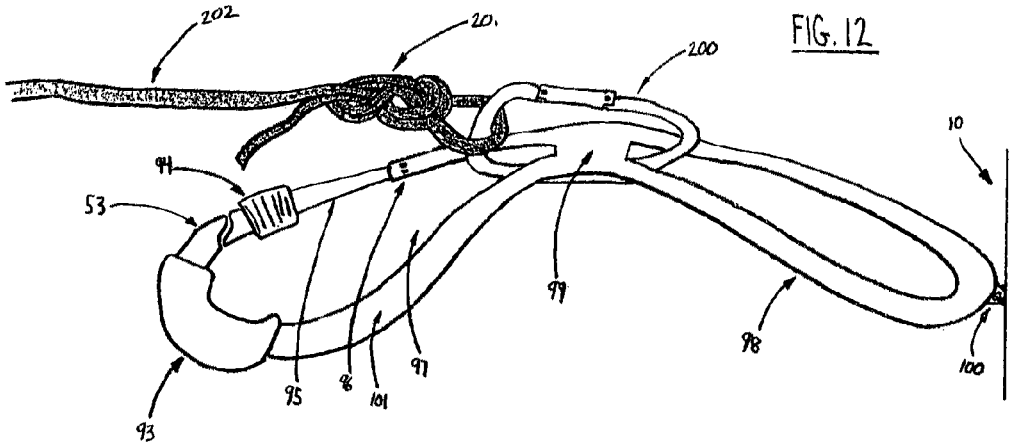

201. Rope knot (not part of the instant invention) featured in FIG. 12 depicting attachment point to carabineer 200 as well as revolver clip 93 in FIG. 14

Figure 13:
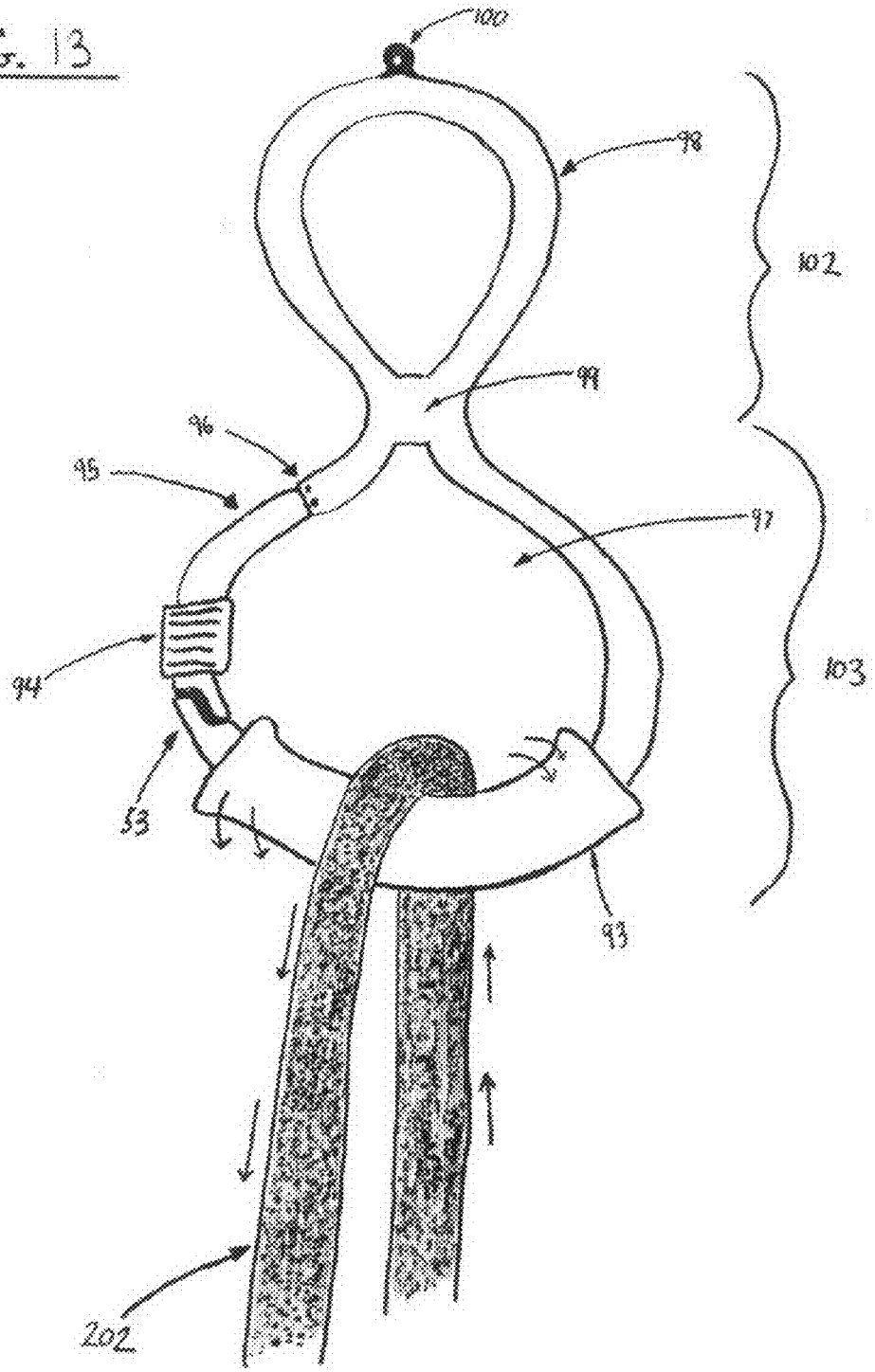

202. Running end of fire service rope (not part of the instant invention) featured in FIG. 12 as well as in FIG. 13 illustrating the directional force and pull creating the mechanical advantage as it rolls over the top of revolver 93

FIG. 1. Anterior view of the Firefighter Rapid Emergency Extraction Device or F.R.E.E Sled with rescue headboard 13 detached FIG. 1(*a*) Disassembled anterior view of rescue headboard 13

Figure 2:
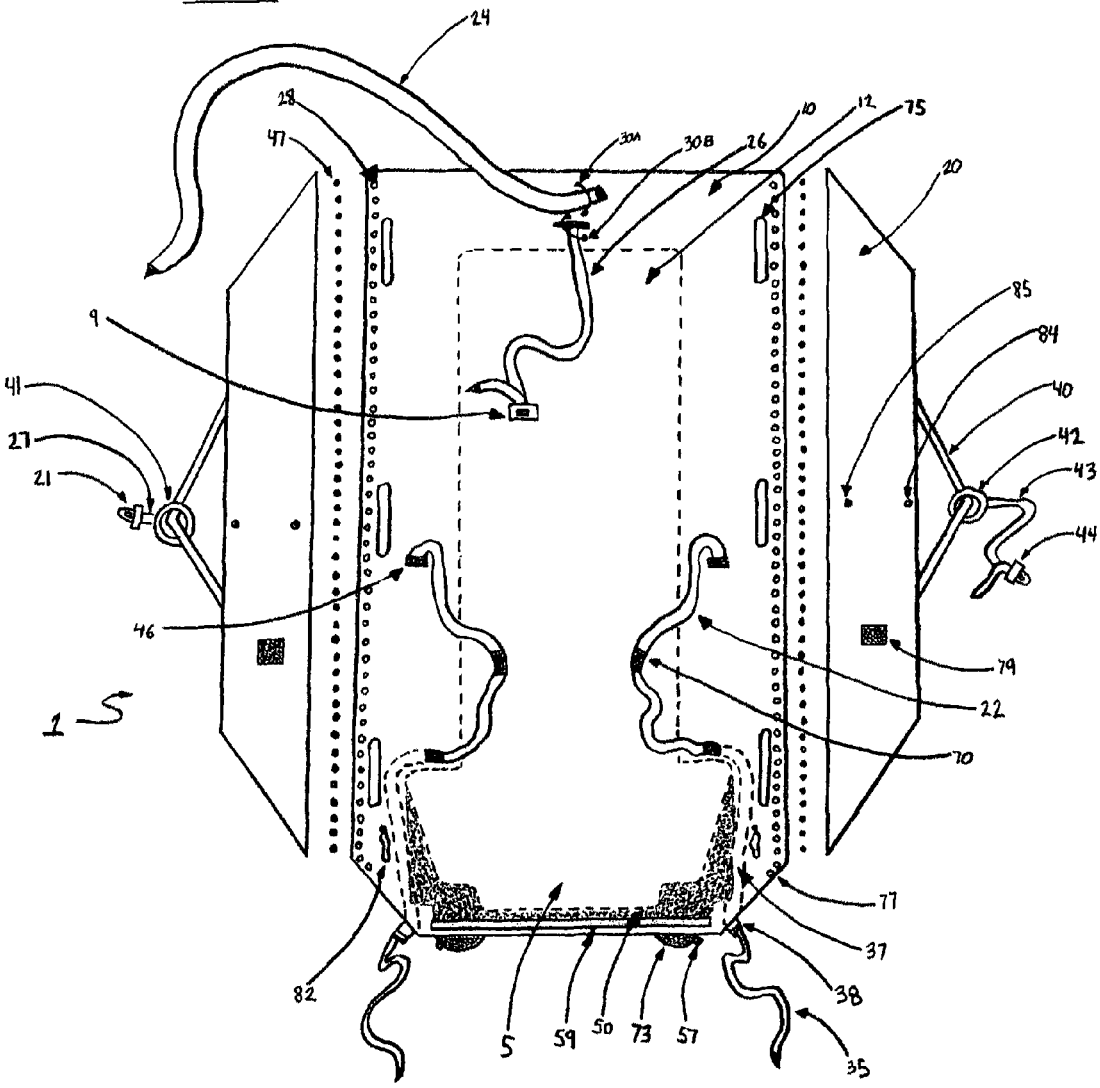

FIG. 2. Disassembled anterior view showing interior portion of interior lateral sleeves 20

FIG. 3. Superior cutaway view of rescue board 10 with rescue head board 13 in the upright position on rigging plate 6 with associated straps & hardware in the fully deployed state including sling strap 52, M.A.R.C.-8 Hardware 60 and grab bar 31

FIG. 3(*a*). Superior cutaway view of rescue board 10 with rescue headboard 13 in the upright position depicting associated straps & hardware on rigging plate 6 in the fully packaged state FIG. 4. Posterior view of rescue board 10 with sub-board handles 33 & 34 shown as well as dorsal end slopes including ladder runner rails 17

Figure 5:
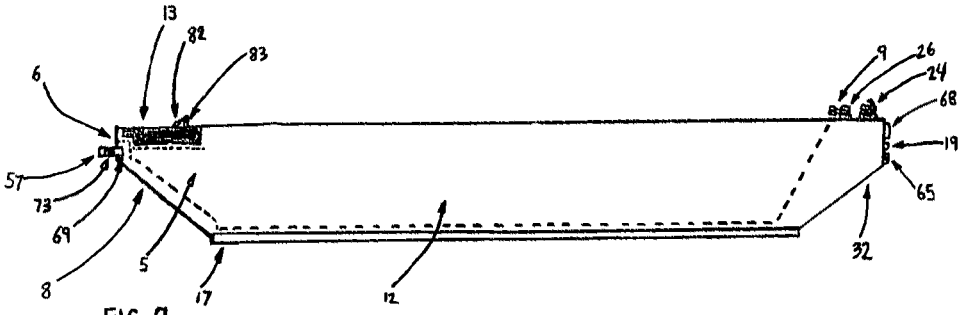

FIG. 5. Lateral cutaway of rescue board 10 depicting recessed helmet well 5, bottle well 12, and a cross section view of rescue head board 13 in the unlocked & stowed away flat position FIG. 6. Close up view of M.A.R.C.-8 (Mechanical Advantage Revolver Clip & Figure-8 Anchor) Hardware System FIG. 7. Lateral cutaway of rescue board 10 depicting recessed helmet well 5, bottle well 12, and a cross section view of rescue head board 13 in the deployed, upright & locked position without a firefighter victim FIG. 8. Superior cutaway view of rescue board 10 showing foot rigging plate 18 with associated straps & hardware packaged in the fully deployed state FIG. 8(*a*). Superior cutaway view of rescue board 10 showing foot rigging plate 18 with associated straps & hardware packaged FIG. 9. Lateral cutaway with fully dressed FF in place including subsurface cross section depicting helmet well 5 & bottle well 12 in the occupied state FIG. 10. Close up lateral cross section rescue board 10 depicting a profile of headboard 13 in the locked & deployed position including manual slide crescent locks 69 interlocking with headboard base-lock openings 71 including recessed helmet well 5 and recessed bottle well 12 depicted FIG. 11. Close up lateral profile view of the M.A.R.C.-8 Hardware System depicting the boomerang shaped arch that exists at eight plate interface 99

Figure 11:
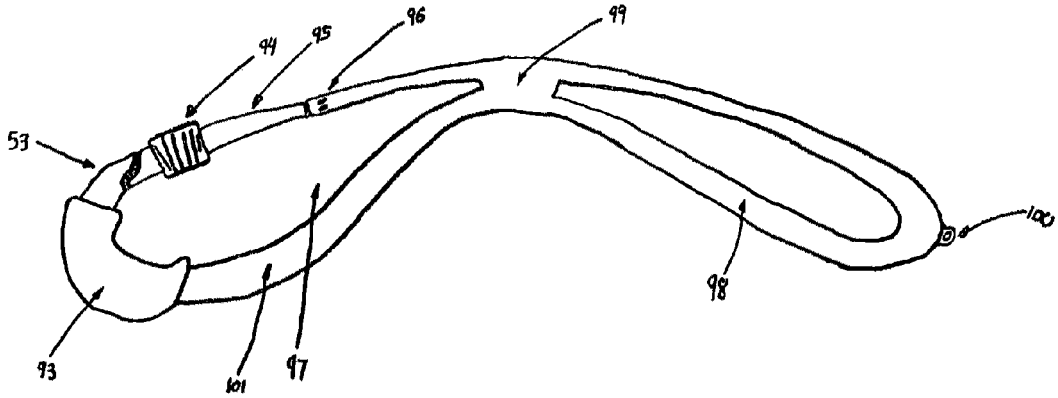

FIG. 12. Similar view as FIG. 11 showing a close up lateral view of the M.A.R.C.-8 Hardware depicting the boomerang shape further illustrating the hard fixed anchor system 102 in place by means of hard fixed anchor ring 98 attached to a metal carabineer 200

Figure 6:
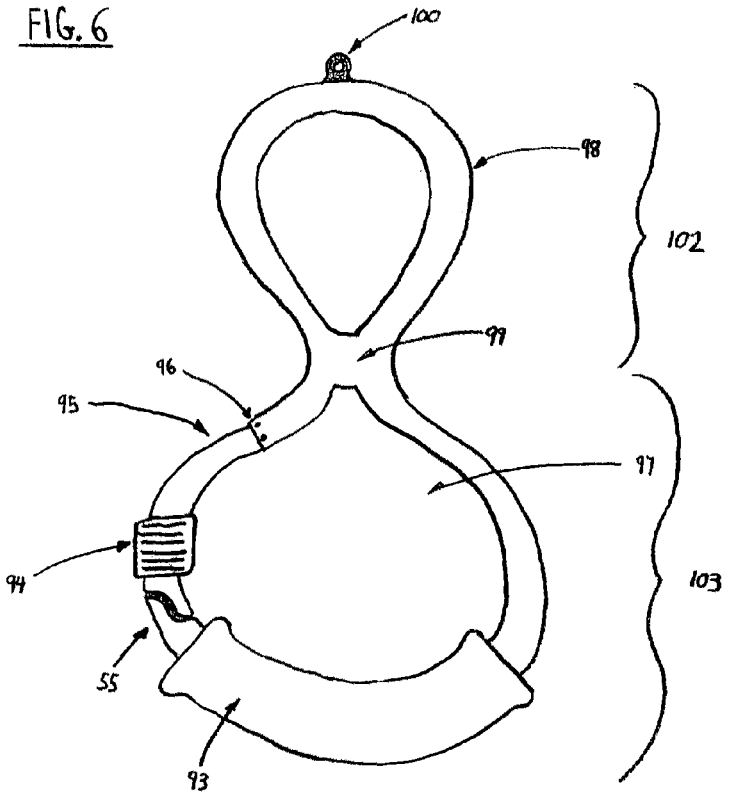

FIG. 13. Similar close up anterior view as FIG. 6 showing the middle of rope 202 in a bend clipped and/or ran through ring 97 of gated mechanical advantage revolver clip system 103. Further illustration shows the running end of rope 202 passing over revolver clip 93 resulting in a 2:1 mechanical advantage system to exist FIG. 14. Close up lateral profile view of the M.A.R.C.-8 Hardware device depicting the use of a soft anchor system by means of rope knot 201 clipped inside gated mechanical advantage revolver clip system 103 further securing soft anchor rope knot 201 to revolver 93

DESCRIPTION OF THE PREFERRED EMBODIMENT

Turning to FIG. 1, the entire Firefighter Rapid Emergency Extraction device, FREE Sled, 1 is shown in an anterior overhead view. Rescue headboard 13 is disassembled from rescue board 10 and shown in FIG. 1(*a*) to allow view of adjustability of headboard 13 as well as the features of rescue board 10 in full view. The instant FREE Sled 1 is shown with exterior lateral sleeves 11 attached however not secured to each other to allow view of the internal components of the device as well. Seen between the views of exterior lateral sleeves 11 and self-equalizing cross straps 40, recessed bottle well 12 and helmet well 5 can also be in full view. Adjacent to these recessed wells that allow a firefighter victim's posterior projecting backpack mounted air tank as well as the rear-facing brim of the firefighters helmet shows the built in victim harness system 22 in the ready state. Referring to FIG. 2 allows presentation of how victim harness shoulder straps 22 flap open to the sides when exterior lateral sleeves 11 are widened for firefighter loading and packaging by means of shoulder strap Velcro holding tabs 70 attached to Velcro holding tabs 79. Once firefighter loading is complete, the rescuer simply pulls the terminated ends of those shoulder straps 22 at the top of the rescue board labeled pull straps 35. Pull straps 35 are permanently threaded through lock & cam 38 so that a simple unidirectional tug on the strap is all that is needed to lock the firefighter victim in place. In-board subsurface strap channels 37 provide that under cover protection to allow the twin-strap pull facilitation without entanglement or obstruction from above. Exterior lateral sleeves 11 are depicted in FIG. 2 as interior lateral sleeves 20 for the interior view. Also shown on interior lateral sleeves 20 are male and female lateral sleeve security snaps 84 & 85 to facilitate the hold on the interior face of interior lateral sleeves 20 when they are rolled inward towards each other on either side. This inward roll is to allow lateral sleeve 20 to be snapped to the lateral sides in order to facilitate firefighter victim loading into the center holding wells 5 & 12. Adjacent to helmet well 5 is another shadowed shape in the outline to portray the 1" deep seat for horizontally laid rescue headboard 13 that would later occupy it when in the stowed flat away state as in the profile image seen in FIG. 5. The darker shadowed image shown in both FIG. 1 & FIG. 2 is headboard base channel 59, which allows the same headboard 13 to sit vertically when in the loaded, upright deployed state later viewed in the lateral profile image depicted in FIG. 7. The RIC security strap 24 and lower extremity strap 27 seen in the lower half of rescue board 10 in FIG. 1 are shown in the deployed state. 30*a* & 30*b* are shown to imply proper roll up and storage of these straps when in the stowed away state. RIC security strap 24 would remain rolled up unless the victim firefighter was in need of a RIC air supply. At such time the RIC bag would be placed between the lower extremities of the victim firefighter as to allow RIC security strap 24 to pass through the handle of said RIC air bag before running through COD (Change of Direction) bar 25 creating a change of direction so that the Velcro may adhere to itself securing the RIC bag in place. Some applications may exist that adapt for a RIC bag to be carried to a victim location, however, most devices fail to make the necessary provision to secure the RIC bag and equipment with a properly placed security strap in the most prone location of such said equipment. RIC bag security strap 24 is color coded to match the universal color of RIC bag equipment, preferably yellow, which also matches the RIC bag COD bar 25, also preferably yellow in color. Further implied in FIG. 1 is lower extremity strap 26 shown with female buckle. Not realized in the image is that strap 26 is color coded to match male buckle 21 for quick reference and connection. Male buckle 21 is fixed upon freely moving COD (Change of Direction) ring 41 which is also color coded to match, preferably fluorescent orange, cross chest tensioning belt 43 and buckle 44 so that it too may be pulled back against itself for terminated connection at matching color coded, preferably fluorescent orange, female buckle 45. Tensioning this cross strap 43 after it has passed through COD ring 41 and fastened to buckle 45 allows the entire outer shell ensemble of exterior lateral sleeves 11 to snug down tightly on the victim firefighter. These two buckle connections of 9 to 21 and 44 to 45 is all that is needed to secure the entire victim inside the rescue board once the shoulder strap tabs 35 are pulled tight. This simple strap and harness system entails the Twin Strap-2 Snap Buckle Process to secure the victim instead of the difficulty and plurality of straps seen in many devices of prior art.

Turning to FIG. 3, shows a view of the superior end of rescue board 10 seen with emphasis on rescue headboard 13 in the loaded position as well as rigging plate 6 with associated hardware. FIG. 3(*a*) shows rescue headboard 13 in the upright & loaded position with rigging plate 6 and associated hardware in the non-deployed state, fully packaged state. Aluminum grab handle 31 is recessed in bar grab handle seat 80. M.A.R.C.-8 hardware is tucked away within Velcro storage pouch 36. The Velcro is lightweight so that M.A.R.C.-8 hardware 60 may be quickly retrieved with a gloved hand of a rescuer in one motion. Top snap buckle 92 holds storage pouch 36 upright. 1" tubular webbing sling strap 52 is carefully stowed away at the base into dual storage pouches 51 that have an elastic opening only partially closed as to allow the sling strap to pull out easily when deployed while at the same time keeping the bundle of strap inside just as long as Velcro split pouch 48 keeps the midline loop of sling strap 52 in the elevated position. The close proximity of left & right Velcro split pouches 48 from each other create a grab loop for the rescuer to deploy with a gloved hand and without requiring dexterity to accomplish. Adjacent to rigging plate 6 is lateral side exterior 88 featuring pull straps 35, locking clip & cam 38, along with a female Velcro hold tab to hold pull straps 35 up and out of the way once a victim firefighter is loaded and secured. FIG. 3A, shows a superior cutaway of rescue headboard 13 and rigging plate 6 in the fully deployed state. Sling strap 52 is elongated with split pouch covers 48 in the downright position further exposing the Velcro holding strips 86. Pull straps 35 are elongated and pinned up to hold tab 3 via male end Velcro hold tab 2 just proximal to the terminated end of pull strap 35 and distal to locking clip & cam 38. This angle also shows lateral protection wing guards 7 with only vertical attachments to headboard 13 via Kevlar/elastic flex-fit binding rings 54 and only two more flex-fit binding rings 76 attaching the horizontal wing guards 7 at the terminated tip to rescue board 10

Figure 4:
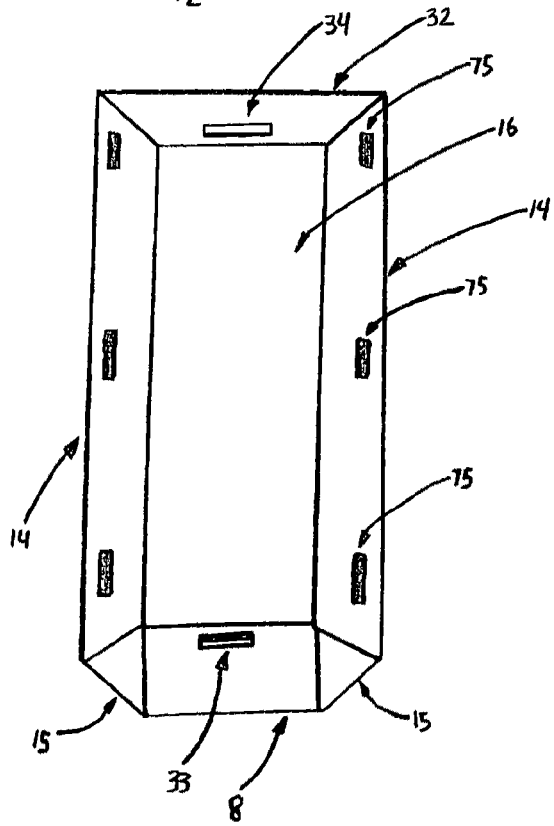

Turning to FIG. 4, there are sub-board handle grips 33 & 34 on the dorsal side exterior of rescue board 10 at both the superior end 8 extending downward from head-board rigging plate 6 to dorsal mid-plate 16 as well as the dorsal side exterior 32 at the inferior end extending downward from footplate 18 to mid-plate 16. These sub-board handle grips allow difficult hand positioning during emergency egress circumstances when the victim must be lifted up and over debris, up or down a staircase or out a window onto fire service ground ladders by rescuers attempting to grasp leverage from the underside of rescue board 10. The sub-board handle grip 33 at the superior end and at the inferior end via sub-board handle grip 34 are placed just at the right locations while not interrupting the smooth transitioning surface of the posterior aspect of bottle well 12 wherein facilitating rescue board 10 to simply slide amongst the myriad of debris ridden obstacles on the floors of the ITIU concerned while at the same time providing critical hand placement fixtures not realized until precisely at the time of need.

Turning to FIG. 5, lateral cutaway of rescue board 10 shows the depth and shape of recessed helmet well 5 and bottle well 12 in addition to ladder seat runner rails 17 on the dorsal posterior. Rescue headboard 13 is in the stored and locked state via flex-fit ring loops 82 which wrap around headboard security posts 83 and remain in tension while the headboard 13 is in the horizontal state seated into recessed storage seat 50 allowing for the reduced profile of the instant invention, Firefighter Rapid Emergency Extraction device. Having this reduced profile allows the F.R.E.E. Sled 1 to take up no more room than the width of rescue board 10 when rescue head-board 13 is recessed into storage seat 50 and in the stowed away state. The collapsibility of rescue headboard 13 into a horizontal position into recessed storage seat 50 provides the ability for the instant invention to be stored onto any emergency response vehicle that provides emergency backboard equipment via the standardized emergency backboard compartment located in almost every fire engine, fire rescue vehicle and emergency response ambulance in the country.

Figure 7:
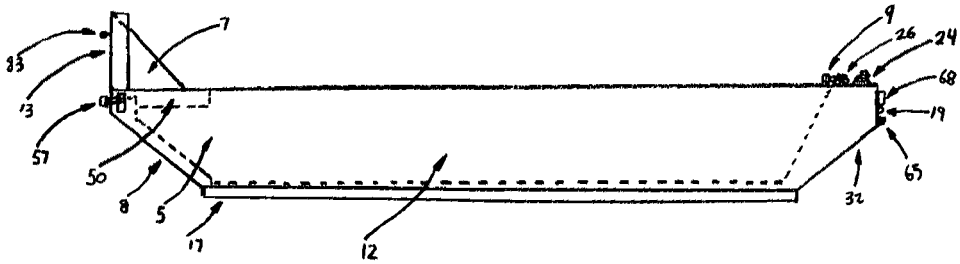

FIG. 7 is the same lateral view of rescue board 10 depicted in FIG. 5 except that rescue headboard 13 is in the vertical position. Hyphenated hash marks were added to illustrate the changes in recessed areas between headboard storage seat 50, helmet seat 5 and bottle well 12. There is also detail relating to narrowed inferior headboard base 58 dropping into base channel 59 and locking into place via crescent locks 69. See FIG. 10 for an enlarged blowup view of these details of baseboard 58, channel 59 and crescent locks 69.

Turning to FIG. 6 illustrates a blow up view of the entire M.A.R.C.-8 hardware (Mechanical Advantage Revolver Clip & Figure 8 Anchor) System. The top half of the device is a hard fixed anchor system 102 and is non-gated. Figure eight-plate interface 99 provides the hardened anchor point for carabineer attachment and provides the intersection of systems 102 & 103 of the M.A.R.C.-8 Hardware. Swing gate 95 articulates inward to soft anchor/mechanical advantage ring 97 via hinge bolts 96. Swing gate 95 is under outward tension and remains inline for screw gate 94 to lock it down by the presence of swing gate stopper 53.

Figure 8:
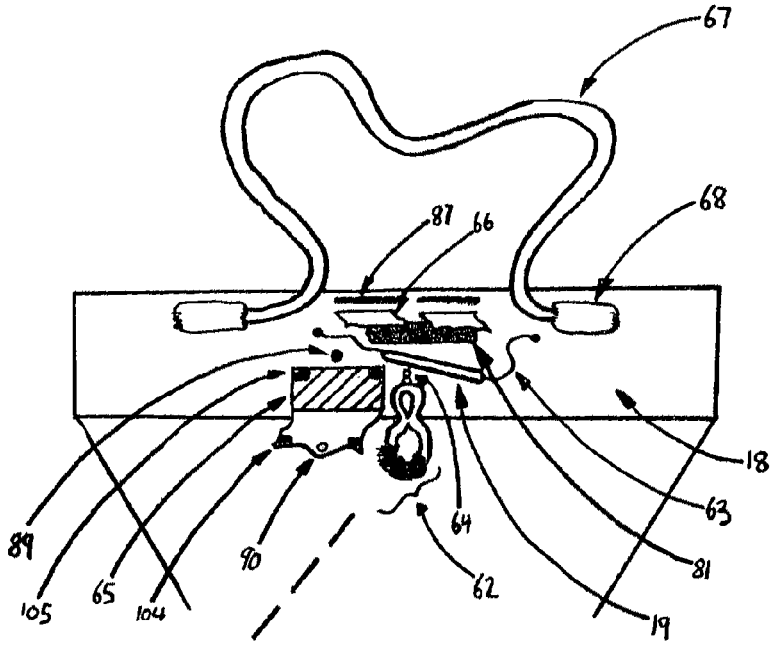
Figure 8A:
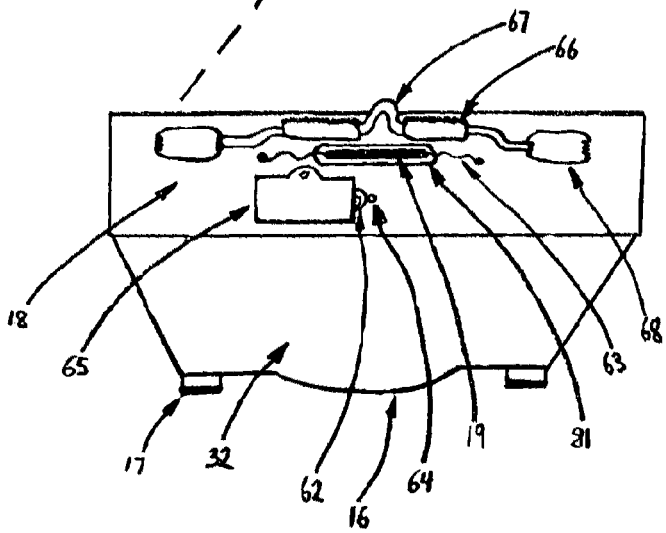

Turning to FIG. 8, the same M.A.R.C.-8 hardware system exists at footplate 18 illustrated by hardware 62 swinging freely on connector ring 64. All of the functions of rigging plate 6 exist on footplate 18 so that the board can be utilized from either direction if it had to. Priority use would be from the head portion, however, rescue board 10 can be operated from either direction. In fact sling strap 67 can be converted into an extremity wrap where it acts as a sling hammock to the firefighter victim's legs elevating them off the ground while at the same time steering the victim and rescue board 10 with assistance of the victims lower extremities. Sling strap 67 would be brought from beneath the middle legs extending over top of the victims legs in a wrap so the loops can be fed through the lateral sides of strap 67 as they originate just distal to footplate 18 forming a girth hitch. This extremity wrap is very effective because strap 67 is fixed to the board requiring no knots or special hardware attachments to facilitate it.

Figure 9:
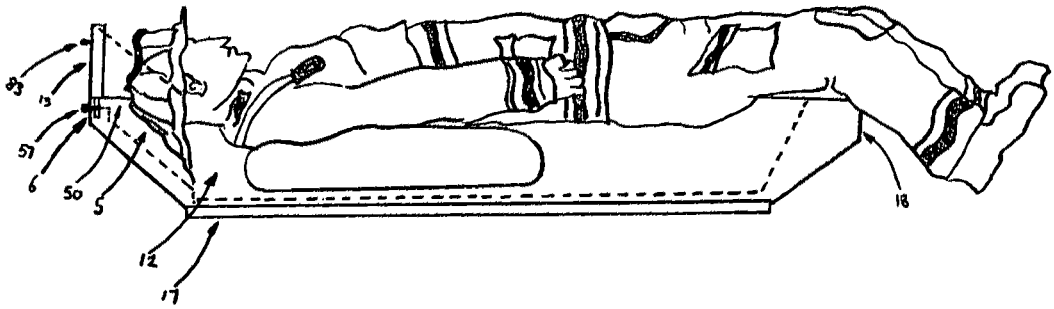

Turning to FIG. 9, a victim firefighter is shown in place with fire helmet recessed into helmet well 5, backpack mounted air supply bottle recessed into bottle well 12 and middle legs passed over the area where lower extremity strap 26 is practically positioned. Rescue headboard 13 and lateral protection wing guards 7 protect the firefighter from oncoming debris as well as prohibit the fire helmet from becoming a snag hazard to obstacles commonly found in emergency egress of the ITIU by not only providing the recessed well for profile reduction purposes, but completing the total encasement of the packaged firefighter so that lateral sleeves 20 can envelope the top portion of the packaged victim firefighter. By providing for the underside entanglement protection via the sloped posterior side of rescue board 10 shown in FIG. 4, as well as the top side protection from the entanglement prone portions of the victim firefighter's gear via lateral sleeves 20, the emergency rescue board 10 stands to envelope the victim in order to facilitate a smooth egress amongst debris ridden floor areas of the ITIU.

Figure 10:
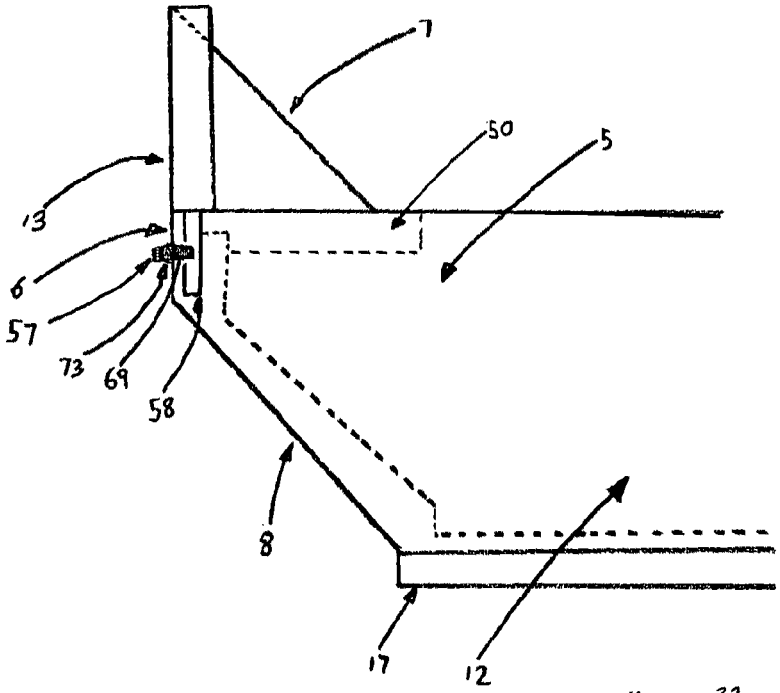

Turning to FIG. 10, an enlarged lateral view of rescue board 10 at the intersection of rescue headboard 13 in the vertical position. This figure is a blowup view of the head portion of FIG. 7 with hyphenated hash marks to illustrate the changes in recessed areas between headboard storage seat 50, helmet seat 5 and bottle well 12. There is also detail relating to narrowed inferior headboard base 58 dropping into base channel 59 and locking into place via crescent locks 69 in an enlarged view.

FIG. 11 is a lateral profile of FIG. 6 depicting all the functions of the M.A.R.C.-8 hardware. A beneficial view in FIG. 11 is at the figure eight-plate interface 99 showing the boomerang type shape that the hardware presents as. When attaching carabineers to hard fixed anchor ring 98 it is the figure eight-plate interface that gets hooked by the attaching hardware. Also the hardware projects into soft anchor/mechanical advantage ring 97 so having the device dip downward like shown in FIG. 11 is paramount to ensure that the revolver clip 93, screw gate 94, swing arm 95 and spine 101 are all out of the way for hard anchor use. If the rescuer cares to utilize a soft anchor system, such as a rope knot on a loop, this can be attached right onto revolver 93 for an extended anchor use. Any hardware equipment intended to be attached to the M.A.R.C.-8 Hardware system should be attached to system 102. Revolver clip and soft anchor system 103 has a plurality of connecting options so that the rescuer has whatever is needed in one simple to use device. Revolver clip and soft anchor system 103 functions as a 2:1 mechanical advantage system when a rope end is passed through soft anchor/mechanical advantage ring 97. Often times the terminated end of a rope is not available for passage through an attachment so a gated option is readily available via swing gate 95. With a simple clip of a rope bend a 2:1 mechanical advantage system is created by means of revolver cylinder 93 spinning in place of a single sheave pulley. In traditional settings a pulley would not have the simple gated function to allow a rope to be clipped right into the system. Having a traditional pulley would mean that a separate connection to a carabineer would need to be disassembled, the pulley counter twisted in order to open it up and feed the rope inside before having to close up and reattach the pulley to the carabineer. Even after all this one would still need to attach it somehow to the carrying device. The M.A.R.C.-8 Hardware system is completely ready to use when you need it whether it be a hard anchor ring, fixed connection, soft rope anchoring system, or a 2:1 mechanical advantage required, the M.A.R.C.-8 Hardware delivers a plurality of connecting options in a simple to use, one device fits all method permanently attached to both sides of the emergency rescue board rigging plates 6 and 18.

Turning to FIG. 12 depicts a similar view to FIGS. 12 & 13, however, a hard metal carabineer is the means of attachment to hard fixed anchor system 102 via hard ring anchor component 98. Earlier stated, the carabineer can be connected to soft-anchor mechanical advantage ring 97 without compromise although the revolver clip 93 was not intended to receive a hard metal attachment. Hard fixed anchor system 102 was specifically designed for a metal carabineer anchoring attachment further illustrated by the lack of a gated option to ring 98. If a user approaches the system with a gated carabineer is his hand, then the attachment of choice would be to ring 98, locking around figure eight plate interface 99. If the user does not have a gated or clippable means of attachment in his hand then the clippable option of swing gate 95 via ring 97 on the lower ring of M.A.R.C.-8 Hardware via gated mechanical advantage revolver clip system 103 would be the attachment of choice. Fixed connector ring 100 allows M.A.R.C.-8 hardware 60 to swing freely into storage pouch 36 (seen in FIG. 3) or into position for deployment on the superior end or on M.A.R.C.-8 hardware 62 (seen in FIG. 8) via connector ring 64 on the inferior end.

Turning to FIG. 13 illustrates the versatility of ring 97 by means of revolver clip 93 whether or not the terminated end of a rope was fed through ring 97 or the middle of a rope is clipped through swing gate 95 allowing entrance into ring 97. Again, swing gate 95 offers a user the versatility of deploying the system whether he has a terminated piece of rope in his hand or he has the middle bend of a rope available; whether there is a knot in the end or a looped piece of webbing strap is attached to a terminated piece; whether there is a metal carabineer as a clip intended for a run of rope through the middle; all of these options are available to a user on both ends of the board since the M.A.R.C.-8 Hardware system is present on rigging plate 6 as well as foot plate 18. FIGS. 6, 11, 12 & 13 all depict the M.A.R.C.-8 Hardware in specific itemized detail and in no way vary depending on which rigging plate it is mounted from. M.A.R.C.-8 Hardware 60 on rigging plate 6 and M.A.R.C.-8 Hardware 62 on foot plate 18 are identical systems and therefore feature accurately in FIGS. 6, 11, 12, & 13 regardless of location. In FIG. 13 two runs of rope 202 would be running from system 103 passing over the top of revolver clip 93. If one side of this rope is secured while forces are generated to the other running end, this creates a 2:1 mechanical advantage system. If both ends of the rope 202 are pulled in the same direction then this same connection acts as an anchoring device. Depending on what the user intends to deploy, the M.A.R.C.-8 Hardware offers a plurality of connecting options therefore maximizing the versatility of this one, simple and easy to deploy system that meets all the demands of emergency victim extraction without the plurality of attachments and complications found in traditional extraction/hauling systems.

Figure 14:
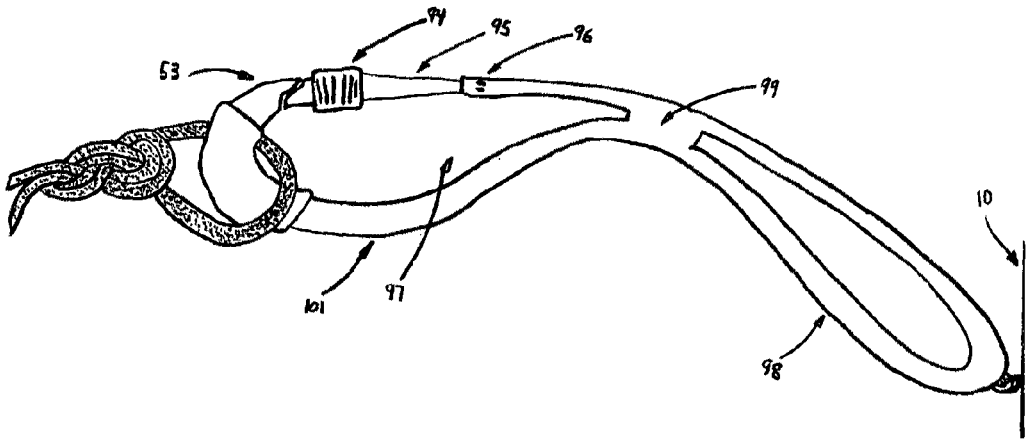

Turning to FIG. 14 is a close up detailed lateral view of the M.A.R.C.-8 Hardware system featuring the gated mechanical advantage revolver clip system 103 illustrating the benefits of having a gated option on ring 97 allowing a user to simply clip a looped rope in a knot right into the soft anchor/mechanical advantage ring 97. System 103 is designed for either an anchoring system by means of soft attachment or for purposes of mechanical advantage by making use of the revolver clip 93 at the bottom. A carabineer can also be clipped into ring 97 via swing gate 95 however, the revolver clip is not ideal to receive a metal attachment as an anchor point since the revolver itself is a metal moving part. Soft anchor attachments such as rope systems, webbing and hose straps are practical means of attachment for mechanical ring 97 even if revolver 93 is not being utilized as a revolving component.

It should be emphasized that the above-described embodiments of the present invention, particularly, any "preferred" embodiments or measurements, are merely possible examples of implementations merely set forth for a clear understanding of the principles of the invention. The overall Spirit of the instant invention is not only its disclosed form but also in all other conceivable embodiments thereof, is what I seek to protect. Many variations and modifications may be made to the above-described embodiment(s) of the invention without departing substantially from the spirit, scope and principles of the invention. All such modifications and variations are intended to be included herein within the scope of this disclosure and the instant invention and protected by the following claims.

Further, the purpose of the following Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the example embodiments presented herein in any way. It is also to be understood that the procedures recited in the claims need not be performed in the order presented.

I claim:

1. An emergency extraction device for firefighters, comprising:

a board configured to encase a firefighter in full protective gear, said full protective gear including at least a helmet and an air bottle;

said board having an air bottle well and a helmet well, wherein the air bottle well and the helmet are integral with each other, the helmet well having a width greater than a width of the air bottle well;

said board having a base and left and right lateral sleeves extending upwardly from the base;

said board having a headboard with entanglement protection in the form of at least two wing guards, the wing guards being movably connected to each of the left and the right hand sides of the headboard; and a harness system located adjacent the wells, the harness system comprising at least two shoulder straps, each of the at least two shoulder straps being threaded through a subsurface strap channel located in the board, a lock and cam located at a terminal end of each of the subsurface strap channels, and wherein each of the straps have a pull portion extending beyond their respective lock and cam.

2. The emergency extraction device of claim 1, wherein the subsurface strap channels extend along the left and right hand sides of the helmet well.

3. The emergency extraction device of claim 1, wherein the at least two shoulder straps each have at least one holding tab configured to be attached to a holding tab located on each of the lateral sleeves.

4. The emergency extraction device of claim 1, comprising two dorsal runner rails connected to the base of the board;

wherein the rails are parallel, spaced, and configured to permit the device to slide on top of a typical ladder's rungs.

5. The emergency extraction device of claim 1, wherein the wing guards are constructed of a pliable plastic composite.

6. The emergency extraction device of claim 1, comprising at least one grab handle connected to the board.

7. The emergency extraction device of claim 1, wherein the lateral sleeves are trapezoidal.

8. An emergency extraction device for firefighters, comprising:

a board configured to encase a firefighter in full protective gear, said full protective gear including at least a helmet and an air bottle;

said board having an air bottle well and a helmet well, wherein the air bottle well and the helmet are integral with each other, the helmet well having a width greater than a width of the air bottle well;

said board having a base and left and right lateral sleeves extending upwardly from the base;

each of the lateral sleeves having a cross strap extending therefrom with the terminal ends of each cross strap being secured to the lateral sleeve from which it extends, each cross strap having a change of direction ring which is freely movable along the length of its respective cross strap, and each of the change of direction rings being connected to a buckle such that the cross straps may be connected together thereby securing the firefighter between the lateral sleeves;

said board having a headboard with entanglement protection in the form of at least two wing guards, the wing guards being movably connected to each of the left and the right hand sides of the headboard; and a harness system located adjacent the wells, the harness system comprising at least two shoulder straps, each of the at least two shoulder straps being threaded through a subsurface strap channel located in the board, a lock and cam located at a terminal end of each of the subsurface strap channels, and wherein each of the straps have a pull portion extending beyond their respective lock and cam.

9. The emergency extraction device of claim 8, wherein the cross straps, buckles, and change of direction ring are color-coded.

10. The emergency extraction device of claim 8, wherein the subsurface strap channels extend along the left and right hand sides of the helmet well.

11. The emergency extraction device of claim 8, wherein the at least two shoulder straps each have at least one holding tab configured to be attached to a holding tab located on each of the lateral sleeves.

12. The emergency extraction device of claim 8, comprising two dorsal runner rails connected to the base of the board;

wherein the rails are parallel, spaced, and configured to permit the device to slide on top of a typical ladder's rungs.

13. The emergency extraction device of claim 8, wherein the wing guards are constructed of a pliable plastic composite.

14. The emergency extraction device of claim 8, comprising at least one grab handle connected to the board.

15. The emergency extraction device of claim 8, wherein the lateral sleeves are trapezoidal.

16. An emergency extraction device for firefighters, comprising:

a board configured to encase a firefighter in full protective gear, said full protective gear including at least a helmet and an air bottle;

said board having an air bottle well and a helmet well, wherein the air bottle well and the helmet are integral with each other, the helmet well having a width greater than a width of the air bottle well;

said board having a base and left and right lateral sleeves extending upwardly from the base;

said board having a headboard with entanglement protection in the form of at least two wing guards, the wing guards being movably connected to each of the left and the right hand sides of the headboard;

said headboard being connected with a revolver clip and figure-8 anchor system; and a harness system located adjacent the wells, the harness system comprising at least two shoulder straps, each of the at least two shoulder straps being threaded through a subsurface strap channel located in the board, a lock and cam located at a terminal end of each of the subsurface strap channels, and wherein each of the straps have a pull portion extending beyond their respective lock and cam.

17. The emergency extraction device of claim 16, wherein the revolver clip and figure-8 anchor system are releasably stored adjacent the headboard in a pouch.

18. The emergency extraction device of claim 16, wherein the subsurface strap channels extend along the left and right hand sides of the helmet well.

19. The emergency extraction device of claim 16, wherein the at least two shoulder straps each have at least one holding tab configured to be attached to a holding tab located on each of the lateral sleeves.

20. The emergency extraction device of claim 16, comprising two dorsal runner rails connected to the base of the board;

wherein the rails are parallel, spaced, and configured to permit the device to slide on top of a typical ladder's rungs.

21. The emergency extraction device of claim 16, wherein the wing guards are constructed of a pliable plastic composite.

22. The emergency extraction device of claim 16, comprising at least one grab handle connected to the board.

23. The emergency extraction device of claim 16, wherein the lateral sleeves are trapezoidal.

* * * * *